US005919611A

United States Patent [19]

Maruyama

[11] Patent Number: 5,919,611

[45] Date of Patent: Jul. 6, 1999

[54] SILVER HALIDE PHOTOGRAPHIC EMULSION

[75] Inventor: Yoichi Maruyama, Minami-ashigara, Japan

[73] Assignee: Fuji Photo Film Co., Ltd., Kanagawa, Japan

[21] Appl. No.: 09/151,661

[22] Filed: Sep. 11, 1998

Related U.S. Application Data

[62] Division of application No. 08/955,616, Oct. 22, 1997.

[30] Foreign Application Priority Data

Oct. 22, 1996 [JP] Japan ..... 8-297978
Feb. 12, 1997 [JP] Japan ..... 9-041434

[51] Int. Cl.[6] ..... G03C 1/035
[52] U.S. Cl. ..... 430/567; 430/569
[58] Field of Search ..... 430/567, 569

[56] References Cited

U.S. PATENT DOCUMENTS 4,435,501 3/1984 Maskasky ..... 430/434
4,937,180 6/1990 Marchetti et al. ..... 430/567
4,945,035 7/1990 Keevert, Jr. et al. ..... 430/567
5,494,789 2/1996 Daubendiek et al. ..... 430/567

FOREIGN PATENT DOCUMENTS 62-018555 1/1987 Japan .

*Primary Examiner*—John A. McPherson
*Attorney, Agent, or Firm*—Birch, Stewart, Kolasch & Birch, LLP

[57] ABSTRACT

A silver halide photographic emulsion comprise silver chlorobromide or silver iodobromochloride grains, each grain having a silver chloride region in an amount of 0.3 to 50 mol % based on the total silver amount of the grain, and each grain containing at least one ion selected from the group consisting of ions of Ga, In and Group 8, Group 9 and Group 10 metals. A silver halide photographic emulsion that is occupied by tabular grains having an equivalent circular diameter of 0.1 to 0.6 $\mu$m in an amount of at least 70% in number, wherein each of the tabular grains has a multilayer structure comprising at least two layers, and at least one of the layers contains chloride in an amount of 0.4 to 20 mol % based on the amount of silver forming the layer, and each of the grains has a silver halide protrusion

4 Claims, No Drawings

SILVER HALIDE PHOTOGRAPHIC EMULSION

This application is a divisional of copending application Ser. No. 08/955,616, filed on Oct. 22, 1997, the entire contents of which are hereby incorporated by reference.

BACKGROUND OF THE INVENTION

The present invention relates to a silver halide emulsion.

More particularly, the present invention is concerned with a silver halide emulsion containing silver halide grains having a silver chloride region therein.

Further, the present invention is concerned with a silver halide photographic emulsion having high sensitivity and provided with effectual means for regulating an interlayer effect.

In the field of color photosensitive materials, especially, color reversal photosensitive materials being often employed by professional photographers, a color photosensitive material with high sensitivity is demanded for taking scene photographs such as sports photographs requiring a high shutter speed and stage photographs encountering difficulty in obtaining a satisfactory amount of light for exposure. However, the conventional highly sensitive photosensitive materials for color photography have coarse graininess, so that an improvement is desired in the relationship of sensitivity/graininess.

Various techniques can be used for enhancing the sensitivity of the silver halide emulsion. With respect to the metal doping technique, it is disclosed that conducting a grain formation in the presence of any of various metals capable of becoming a shallow electron trap (SET) in grains to thereby effect doping in the grains is effective in enhancing sensitivity, in connection with silver bromide grains in, for example, U.S. Pat. No. 4,937,180, and silver iodobromide grains and is disclosed in, for example, U.S. Pat. No. 4,945,035 in connection with a system with a composition comprising at least 50 mol % of silver chloride and up to 5 mol % of silver iodide. Moreover, U.S. Pat. No. 5,503,970 and 5,503,971 discloses that grains which have high sensitivity and are excellent in graininess and toughness can be obtained by doping ultrathin silver iodobromide grains having an epitaxial containing silver chloride formed at grain surfaces thereof, with a metal complex having a shallow electron trap.

Processes for producing tabular silver halide grains and techniques for utilizing the same are disclosed in, for example, U.S. Pat. Nos. 4,434,226, 4,439,520, 4,414,310, 4,433,048, 4,414,306 and 4,459,353. The advantages of the tabular silver halide grains are known in, for examples improving the relationship between sensitivity and graininess inclusive of enhancement of the efficiency of color sensitization by a spectral sensitizing dye.

Studies for using the tabular grains possessing the above advantages in large size regions which have an intense impact on the performance of color negative lightsensitive materials have been promoted, and conspicuous progress has been attained with respect to the tabular grains of large size regions, including the sensitivity enhancing technique by dislocation as described in, for example, Jpn. Pat. Appln. KOKAI Publication (hereinafter referred to as JP-A-) No. 63-220238.

In contrast to the lightsensitive color negative material, with regard to color reversal lightsensitive materials, what has an intense impact on the performance of the material is grains of small size regions.

With respect to the tabular grains of small size regions, JP-A-62-115435 discloses tabular grains having a diameter of 0.2 to 0.55 μm and having an aspect ratio of at least 8. However, in the invention described in this publication, attention was drawn to the optical characteristics of grains, and the invention did not lead to the enhancement of sensitivity of small sized tabular grains per se.

Silver halide protrusions are disclosed in, for example, U.S. Pat. No. 5,494,789 and 4,435,501. However, there is no disclosure relating to tabular grains having an equivalent circular diameter of not greater than 0.6 μm, and there has been a demand for development of a technology for enhancing the sensitivity of tabular grains of small size regions.

Interlayer effect technology for improving a color reproduction is important in the field of color photographic lightsensitive materials. With respect to conventional lightsensitive color reversal materials, the regulation of the interlayer effect has been mainly carried out by regulating the silver iodide content of grains. However, the regulation of the interlayer effect by regulating the silver iodide content of grains has a limit, and the development of more effectual means for regulating the interlayer effect has been desired.

BRIEF SUMMARY OF THE INVENTION

The inventor has studied the halogen composition of silver halide and metal doping technique as disclosed in the above literature and has confirmed the effect in enhancing sensitivity and contrast. However, further studies and improvement are required for attaining the now desired high level of sensitivity without detriment to the graininess.

Therefore, it is the first object of the present invention to provide a silver halide photographic emulsion with high sensitivity which is low in a fog level and is excellent in graininess.

Further, the development of tabular grains of small size regions having high sensitivity and having means for regulating the interlayer effect has been desired for the lightsensitive color reversal materials.

Therefor it is the second object of the present invention to provide a silver halide photographic emulsion having high sensitivity, and to provide a silver halide emulsion having means for regulating the interlayer effect.

DETAILED DESCRIPTION OF THE INVENTION

It has been made investigations with a view toward developing a photographic emulsion which exhibits an improved sensitivity/fog ratio and a sensitivity/graininess ratio. As a result, it has been found that it is the most effective in attaining the above first object to employ a complex having a cyano ligand which serves as a shallow electron trap, as the metal compound to be incorporated in grains such as disclosed in U.S. Pat. Nos. 4,937,180 and 4,945,035, and to cause this complex to be present in the vicinity of an interface between two silver halide regions whose halogen compositions are different from each others The present invention has been completed on the basis of this finding.

That is, a first embodiment of the present invention provides the following silver halide photographic emulsions:

(1) A silver halide photographic emulsion comprising silver chlorobromide or silver iodobromochloride grains, each having a silver chloride region in an amount of 0.3 to 50 mol %, based on the total silver amount of the grain, and each containing at least one ion selected from the group consisting of ions of Ga, In and Group 8, Group 9 and Group 10 metals;

(2) The emulsion according to item (1) above, wherein each of the grains contains 1 to 7 mol % of silver iodide based on the total silver amount of the grain;

(3) The emulsion according to item (1) or (2) above, wherein the emulsion is occupied by tabular grains having parallel (111) planes as major planes and having an aspect ratio of at least 3 in an amount of 50% of the total projected area of the grains;

(4) The emulsion according to any of items (1) to (3) above, wherein the at least one ion is selected from the group consisting of ions of Ga, In and Group 8, Group 9 and Group 10 metals, and is contained locally at an interface of the silver chloride region with another silver halide region;

(5) The emulsion according to any of items (1) to (4) above, wherein the silver chloride region is present at the outermost surface of each grain;

(6) The emulsion according to any of items (1) to (5) above, wherein the ion is selected from the ions of Group 8, Group 9 and Group 10 metals and is present in the form of a metal complex comprising this metal ion as a central metal and 1 to 6 $CN^-$ligands; and (7) The emulsion according to any of items (1) to (6) above, wherein the metal complex is a hexacyano complex.

The above second object have been attained by a second embodiment of the present invention described in items (8) to (11) below:

(8) A silver halide photographic emulsion that is occupied by tabular grains having an equivalent circular diameter of 0.1 to 0.6 $\mu$m in an amount of at least 70% in number, wherein the tabular grains:

having a multilayer structure comprising at least two layers, and at least one of the layers contains chloride in an amount of 0.4 to 20 mol % based on the amount of silver forming the layer, and having a silver halide protrusion;

(9) The emulsion according to item (8) above, wherein a spectral sensitizing dye was added before a water washing step to produce the emulsion;

(10) The emulsion according to item (8) above, wherein each tabular grain has an outermost layer whose silver iodide content is 5 to 30 mol % based on the amount of silver in the outermost layer; and

(11) The emulsion according to item (10) above, wherein a spectral sensitizing dye was added before a water washing step to produce the emulsion.

The first embodiment of the present invention will be described in detail below.

The emulsion grains are composed of silver chlorobromide or silver iodobromochloride in which a silver chloride region is present, preferably, the emulsion grains are composed of silver iodobromochloride in which a silver chloride region is present. Since the variation coefficient of grain size distribution is preferably 20% or less, in case the silver halide composition of the grain is silver iodobromochloride, the silver iodide content preferably ranges from 1 mol % to 7 mol %.

With respect to the silver iodide distribution of the emulsion grains, the grains may have a structure within the grains with respect to silver iodide, or silver iodide may be uniformly distributed within the grains. Lowering the silver iodide content facilitates decreasing the variation coefficient of the grain size distribution of the grain. The variation coefficient of distribution of intergranular silver iodide content is preferably 20% or less, particularly preferably 10% or less.

Although the emulsion grains of the first embodiment of the present invention may be either regular grains of, for example, cubic or octahedral configuration or tabular grains, tabular grains are most preferable.

In the tabular grain emulsion, it is preferred that grains having an aspect ratio of at least 3 occupy at least 50% of the total projected area of the grains. The projected area and aspect ratio of the tabular grains can be measured from an electron micrograph according to the technique of carbon replica shadowed together with spherical latex particles for reference. The tabular grains, when viewed from above the major plane, generally have a hexagonal, triangular or circular shape, and the aspect ratio is a quotient of the equivalent diameter of a circle having the same area as the projected area of a grain divided by the thickness thereof. The higher the ratio of hexagon, the more desirable the shape of the major planes of the tabular grains. Further, the ratio of lengths of mutually neighboring sides of the hexagon is preferably not greater than 1:2.

The greater the aspect ratio is, the more conspicuous the effect attained by the first embodiment of the present invention. Thus, still preferably, grains having an aspect ratio of 5 or more occupy at least 50% of a total projected area of the tabular grains. Although it is especially preferred that grains having an aspect ratio of 8 or more occupy at least 50% of the total projected area of the tabular grains, too large aspect ratios tend to enlarge the above variation coefficient of grain size distribution. Thus, it is generally preferred that the aspect ratio does not exceed 20.

The emulsion grains of the first embodiment of the present invention have a diameter of a circle with the same area as the projected area thereof ranging from 0.15 to 1.80 $\mu$m.

The tabular grain emulsion preferred in the first embodiment of the present invention is composed of mutually parallel (111) major planes and side faces linking the major planes together. At least one twin plane is interposed between the major planes. Generally, two twin planes are observed therebetween in the tabular grain emulsion of the first embodiment of the present invention. The distance between the twin planes can be less than 0.012 $\mu$m as described in U.S. Pat. No. 5,219,720. Further, the quotient of the distance between the (111) major planes divided by the distance between the twin planes can be at least 15 as described in JP-A-5-249585.

When photons are absorbed in silver halide grains, electrons (hereinafter referred to as "photoelectrons") are leveled up from the valence band of silver halide crystal lattice to the conduction band thereof with the result that holes (hereinafter referred to as "photoholes") are created in the valence band. For producing latent image sites in the grains, it is required that a plurality of photoelectrons produced by a single imagewise exposure reduce some silver ions within the crystal lattice to thereby form small Ag atom clusters. The photographic sensitivity of silver halide grains is decreased to such a level that photoelectrons are scattered by the competition mechanism prior to the formation of latent image. For example, if the photoelectrons return to photoholes, the energy is scattered without contributing to latent image formation.

It is contemplated to create within the grains a shallow electron trap which contributes to efficiently use photoelectrons for latent image formation. This can be attained by introducing in a face-centered cubic crystal lattice a dopant which exhibits a net valence positive to the net valence of ion (single or at least two) that is to be substituted in the crystal lattice. For example, in the simplest possible form, the dopant can be a polyvalent (+2 to +5) metal ion. The polyvalent metal ion is substituted for silver ion ($Ag^+$) in the crystal lattice structure.

For example, when a monovalent $Ag^+$ cation is substituted for a divalent cation, a crystal lattice having a local net positive charge is left. Thus, the energy of the conduction band is locally lowered. The level of lowered local energy of the conduction band can be estimated by applying the effective mass approximation as described in J. F. Hamailton, Advances in Physics, vol. 37 (1988), page 395 and Excitonic Processes in Solids, H. Ueta, H.Kanazaki, K.Kobayashi, Y.Toyozawa and E.Hanamura (1986), published by Springer-Verlag in Berlin, page 359.

When the crystal lattice structure of silver chloride is donated with a net positive charge of +1 by doping, the energy of the conduction band is lowered as much as about 0.048 electron Volt (eV) in the vicinity of the dopant. When the net positive charge is +2, the shift is about 0.192 eV. In the crystal lattice structure of silver bromides the energy of the conduction band is locally lowered as much as about 0.026 eV by the net positive charge of +1 donated by the doping. When the net positive charge is +2, the energy lowering is about 0.104 eV.

When photoelectrons are produced by the absorption of light, the photoelectrons are attracted at the dopant site by the net positive charge and temporarily retained (namely, bonded or captured) at the dopant site with a bonding energy equal to a local drop of the conduction band energy. With respect to a dopant which causes a local deflection of the conduction band toward a lower energy, the bonding energy that retains (traps) photoelectrons at the dopant site is not sufficient for permanently holding the electrons at the dopant site, so that it is called "shallow electron trap". Nevertheless the shallow electron trap site is useful. For example, an extremely large amount of photoelectrons produced by a high illuminance exposure can be prevented from immediately scattering by causing the shallow electron trap to temporarily retain the photoelectrons, while the photoelectrons are caused to enable efficiently moving to a latent image formation site over a certain period of time.

For being useful in the formation of the shallow electron traps the dopant must satisfy criteria more than simply providing a net valance which is positive to the net valance of (one or a plurality of) ion that is to be substituted in the crystal lattice. When the dopant is incorporated in the silver halide crystal lattice, not only an orbital or energy level composed of a silver halide valence electron and conduction band but also a novel electron energy level (orbital) is formed in the vicinity of the dopant. For being useful as the shallow electron traps the dopant must satisfy the following additional criteria:

(1) The highest energy electron occupied molecular orbital (HOMO, generally also called "frontier orbital") must be filled, for examples when an orbital can hold two electrons (which is the largest possible number thereof), the orbital must be filled with not one but two electrons; and (2) The lowest energy unoccupied molecular orbital (LUMO) must have an energy level higher than that of the lowest energy level conduction band of silver halide crystal lattice.

If the conditions (1) and/or (2) are/is not satisfied, there is, in the crystal lattice (unfilled HOMO or LUMO), an orbital derived from a local dopant, whose energy is lower than that of the conduction band minimum energy induced by the local dopant. Thus, photoelectrons are preferentially held in the above low energy site, so that efficient move of photoelectrons to the latent image formation site is prevented.

It has been found that metal ions that most satisfy the criterion (1) above are ions of Group 8 metals such as Fe, Ru and Os, Group 9 metals such as Co, Rh and Ir and Group 10 metals such as Ni, Pd and Pt (hereinafter the ions of Groups 8 to 10 are referred to as "GROUP 8 METAL IONS"). It has been found that, when incorporated as a bare metal ion dopant, each of these metal ions cannot form an effective shallow electron trap. This is attributed to the energy level of LUMO being lower than that of the lowest energy level conduction band of silver halide crystal lattice.

Moreover, not only these GROUP 8 METAL IONS but also coordination complexes of $Ga^{3+}$ and $In^{3+}$ can be used as the dopant to form an effective shallow electron trap. The condition that the frontier orbital of each metal ion is filled satisfies the criterion (1) above.

With respect to the criterion (2) above to be satisfied, at least one ligand forming a coordination complex must exhibit stronger electron attractive characteristics than the halide (that is, must exhibit electron attractive characteristics higher than that of fluoride ion that is the most electron attractive halide ion).

One common method of evaluating the electron attractive characteristics is to consult a spectro-chemical series of ligands obtained from an absorption spectrum of a metal ion complex in a solution as mentioned in Inorganic Chemistry: Principles of Structure and Reactivity, James E. Huheey, 1972, Harper and Row, New York and Absorption Spectra and Chemical Bonding in Complexes, C. K. Jorgensen, 1962, Pergamon Press, London. As set forth in the above literature, the ligand order in the spectrochemical series is as follows:

$I^- < Br^- < S^{2-} < SCN^- < Cl^- < NO_3^- < F^- < OH < ox^{2-} < H_2O < NCS^- < CH_3CN^- < NH_3 < en < dipy < phen < NO_2^- < phosph << CN^- < CO$.

Employed abbreviations are as follows: ox=oxalate, en=ethylenediamine, dipy=dipyridine, phen=ophenanthroline and phosph=4-methyl-2,6,7-trioxa-1-phosphabicyclo[2.2.2]octane.

In the spectrochemical series, ligands are arranged in the order of electron attractivity, in which the first ligand ($I^-$) has the lowest electron attractivity and the final ligand (CO) has the highest electron attractivity. The capability of the ligand to increase the LUMO value of the dopant complex increases in accordance with the change of the ligand atom bonded to the metals from chlorine to S, O, N and C in this order. Therefore, the ligands $CN^-$and CO are especially preferred. The other preferred ligands are thiocyanate ($NCS^-$), selenocyanate ($NCSe^-$), cyanate ($NCO^-$), tellurocyanate ($NCTe^-$) and azide ($N_3^-$).

The spectrochemical series is also applicable to metal ions in the same manner as to the ligands of coordination complex. Absorption Spectra and Chemical Bonding, C. K. Jorgensen, 1962, Pergamon Press, London reports the following spectrochemical series of metal ions: $Mn^{2+} < Ni^{2+} < Co^{2+} < Fe^{2+} < Cr^{3+}$, $V^{3+}$(approximately the same as $Cr^{3+}$) $< Co^{3+} < Mn^{4+} < Mo^{3+} < Rh^{3+}$, $Ru^{2+}$ (approximately the same as $Rh^{3+}$)$< Pd^{4+} < Ir^{3+} < Pt^{4+}$.

Although not all metal ions particularly intended to use in the coordination complex as a dopant are included in this spectrochemical series, the position in the spectrochemical series of each metal that is not listed in the series can be recognized on the basis that the position of the ion in the series shifts from the metal $Mn^{2+}$ with the lowest electronegativity toward the metal $Pt^{4+}$ with the highest electronegativity in accordance with the enhancement of the position of the ion in the periodic table of elements from the fourth period to the fifth period and to the sixth period. That is, $Os^{2+}$, which is a sixth period ion, has an electronegativity higher than that of $Pd^{4+}$ having the highest electronegativity in the fifth period but has an electronegativity lower than that of $Pt^{4+}$ having the lowest electronegativity in the sixth period.

$Rh^{3+}$, $Ru^{2+}$, $Pd^{4+}$, $Ir^{3+}$ $Os^{2+}$ and $Pt^{4+}$ are especially preferred metal ions because these are metal ions with the highest electronegativities which satisfy the frontier orbital requirement (1) above as apparent from the above description.

For satisfying the LUMO requirement of the above criterion (2), the polyvalent GROUP 8 METAL IONS with filled frontier orbital are incorporated in the ligand containing coordination complex. Of these, at least one, preferably, at least three and, optimally, at least four ligands have electronegativities higher than that of halides and the other remaining ligand (a single or at least two) is a halide ligand. When the metal ion per se is highly electronegative, like, for example, $Os^{2+}$, only a single ligand is required to have a high electronegativity, such as carbonyl in order to satisfy the LUMO requirement.

If the metal ion per se has relatively low electronegativity like, for example, $Fe^{2+}$, it is necessary for satisfying the LUMO requirement that all the ligands be selected from those with high electronegativity. For example, Fe(II) $(CN)_6$ is specifically a preferred shallow electron trap dopant. Practically, the coordination complex containing 6 cyano ligands is a representative example of the shallow electron trap dopants of generally suitable preferred type.

$Ga^{3+}$ and $In^{3+}$ as bare metal ions can satisfy the HOMO and LUMO requirements, so that, when incorporated in the coordination complex, these can have a broad range of ligands ranging in electronegativity from halide ions to ligands with higher electronegativity which are useful in the coordination complexes of the GROUP 8 METAL IONS. In the case of each of GROUP 8 METAL IONS that is combined with ligands whose electronegativity is intermediate, it can easily be determined whether a specific metal coordination complex satisfies the LUMO requirement, namely, whether the specific coordination complex has a suitable combination of a metal and a ligand having a appropriate electronegativity capable of fulfilling the role as a shallow electron trap. This can be performed by the use of the electron paramagnetic resonance (EPR) spectroscopic analysis. This analytical technique is commonly employed in analyses and is described in Electron Spin Resonances: A Comprehensive Treatise on Experimental Techniques, 2nd edition, Charles P. Poole, Jr. (1983), Jone Wiley & Sons, New York.

In the shallow electron trap, photoelectrons produce an EPR signal which is extremely similar to that observed with respect to photoelectrons lying in the energy level of conduction band of silver halide crystal lattice. The EPR signal from shallowly trapped electrons or conduction band electrons is called the electron EPR signal. This electron EPR signal is characterized by the parameter generally known as g-factor. The method of calculating the g-factor of the EPR signal is described in the above C. P. Poole. The g-factor of the electron EPR signal in the silver halide crystal lattice depends on the type of halide ion (a single or at least two) located in the vicinity of each electron. Specifically, the g-factor of the electron EPR signal is 1.88±0.001 in the crystal of AgCl and 1.49±0.02 in the crystal of AgBr as reported in R. S. Eachus, M. T. Olm, R. Jane and M. C. R. Symons, Physica Status Solidi (b), vol. 152 (1989), pages 583–592.

If the magnitude of the electron EPR signal is at least 20% strengthened in a test emulsion which will be mentioned below and into which a coordination complex is doped, as compared with the corresponding undoped control emulsion, the coordination complex dopant is recognized as being useful for the formation of the shallow electron trap in the first embodiment of the present invention.

The undoped control emulsion is a precipitated AgBr octahedron emulsion (however, the emulsion is not sensitized after the precipitation) of 0.45±0.05 $\mu$m in edge length as described with respect to "control 1A" in the specification of U.S. Pat. No. 4,937,180 (Marchetti, et al.). The test emulsion is prepared in the same manner as in Example 1B of the Marchetti et al., except that the metal coordination complex is used in place of $[Os(CN_6)]^{4-}$, in a concentration intended to employ in the emulsion of the first embodiment of the present invention.

Each of the test and control emulsions for measurement of the electron EPR signal is prepared by centrifuging a liquid emulsion after precipitation, removing a supernatant therefrom, replacing it by the same amount of hot distilled water and resuspending the emulsion. This procedure is repeated thrice, and after a final centrifugation, the obtained powder is dried in the air. These procedures are conducted under safelight condition. The EPR test is conducted by cooling three specimens of each emulsion to 20, 40 and 60° K., respectively, exposing each of the specimens to filtered light of 365 nm in wavelength from a 200 Hg lamp and measuring the EPR electron signal during the exposure. If the intensity of electron EPR signal of the doped test emulsion is conspicuously increased (that is, increased by a degree that is larger than a signal noise, and thus measurable) at any one of selected observation temperatures, compared to that of the undoped control emulsion, the dopant constitutes a shallow electron trap.

As an example of the above test, when $[Fe(CN)_6]^{4-}$, which is a commonly employed shallow electron trap dopant, was added to the above precipitate in a concentration of $50\times10^{-6}$ mol per mol of silver, the electron EPR signal intensity of the doped emulsion increased in the test conducted at 20° K. to 8 times that of the undoped control emulsion.

A hexacoordinated complex is a coordination complex suitable for use in carrying out the first embodiment of the present invention. This complex comprises a metal ion and neighboring six halide ions that are to replace with a metal ion and six ligands in the crystal lattice, respectively. Although one or two of the coordination sites can be occupied by neutral ligands such as carbonyl, aquo and amine ligands, the rest of the ligands must be anions in order to facilitate an efficient incorporation of the coordination complex in the crystal lattice structure.

Practicable examples of the hexacoordinated complexes are disclosed in the specifications of U.S. Pat. Nos. 5,037,732 (Mcdugle, et al.), 4,937,180, 5,264,336, 5,268,264 (Marchetti, et al.), and 4,945,035 (Keevert et al.) and JP-A-249588 (Hurakami et al.), the disclosures of which are herein incorporated by reference. Neutral and anionic organic ligands useful in the hexacoordinated complex are disclosed in the specification of U.S. Pat. No. 5,360,712 (Olm, et al.), the disclosure of which is herein incorporated by reference.

It has become apparent through attentive scientific investigations that the GROUP 8 hexahalocoordinated complex forms a deep (desensitizing) electron trap, as described in R. S. Eachus, R. E. Graves and M. T. Olm, J. Chem. Phys., vol. 69, pages 4580–4587 (1978) and Physica Status Solidi A, vol. 57, pages 429–437 (1980).

In a particularly preferred aspect of the first embodiment of the first embodiment of the present invention, it can be intended to use as a dopant any of the hexacoordinated complexes of the formula:

$$(ML_6)^n \quad \text{(IV)}$$

wherein M represents a polyvalent metal ion with filled frontier orbital, preferably, $Fe^{2+}$, $Ru^{2+}$, $Os^{2+}$, $Co^{3+}$, $Rh^{3+}$, $Ir^{3+}$, $Pd^{4+}$ or $Pt^{4+}$; $L_6$ represents six independently selectable coordination complex ligands, provided that at least four of the ligands are anionic ligands and at least one (preferably, at least 3 and, optimally, at least 4) of the ligands has an electronegativity higher than that of any of halide ligands; and n is $2^-$, $3^{965\ -}$ or $4^-$.

Specific examples of the dopants capable of providing a shallow electron trap include:

| | |
|---|---|
| SET-1 | $[Fe(CN)_6]^{4-}$ |
| SET-2 | $[Ru(CN)_6]^{4-}$ |
| SET-3 | $[Os(CN)_6]^{4-}$ |
| SET-4 | $[Rh(CN)_6]^{3-}$ |
| SET-5 | $[Ir(CN)_6]^{3-}$ |
| SET-6 | $[Fe(pyrazine)(CN)_5]^{4-}$ |
| SET-7 | $[RuCl(CN)_5]^{4-}$ |
| SET-8 | $[OsBr(CN)_5]^{4-}$ |
| SET-9 | $[RhF(CN)_5]^{3-}$ |
| SET-10 | $[IrBr(CN)_5]^{3-}$ |
| SET-11 | $[FeCO(CN)_5]^{3-}$ |
| SET-12 | $[RuF_2(CN)_4]^{4-}$ |
| SET-13 | $[OsCl_2(CN)_4]^{4-}$ |
| SET-14 | $[RhI_2(CN)_4]^{3-}$ |
| SET-15 | $[IrBr_2(CN)_4]^{3-}$ |
| SET-16 | $[Ru(CN)_5(OCN)]^{4-}$ |
| SET-17 | $[Ru(CN)_5(N_3)]^{4-}$ |
| SET-18 | $[Os(CN)_5(SCN)]^{4-}$ |
| SET-19 | $[Rh(CN)_5(SeCN)]^{3-}$ |
| SET-20 | $[Ir(CN)_5(HOH)]^{2-}$ |
| SET-21 | $[Fe(CN)_3Cl_3]^{4-}$ |
| SET-22 | $[Ru(CO)_2(CN)_4]^{2-}$ |
| SET-23 | $[Os(CN)Cl_5]^{4-}$ |
| SET-24 | $[Co(CN)_6]^{3-}$ |
| SET-25 | $[Ir(CN)_4(oxalate)]^{3-}$ |
| SET-26 | $[In(NCS)_6]^{3-}$ and |
| SET-27 | $[Ga(NCS)_6]^{3-}$. |

Moreover, it can be contemplated to employ an oligomer coordinated complex to thereby increase the speed (sensitivity) as taught by U.S. Pat. No. 5,024,931 (Evans et al.), the disclosure of which is herein incorporated by reference.

The dopant exerts an effect in common concentrations (herein, the concentration is based on the total amount of silver contained in the grains of an emulsion). Generally, it is intended to incorporate the shallow electron trap forming dopant in an amount ranging from at least $1\times10^{-6}$ mol per mol of silver to solubility limit (typically, concentration of about $5\times10^{-4}$ mol or less per mol of silver). Preferred concentration of the dopant ranges from about $10^{-5}$ to $10^{-4}$ per mol of silver.

The effect of the dopant is enhanced by placing it at several sections in the silver chloride region, or placing it at several sections in the interface between the silver chloride region and a silver bromide layer or a silver iodobromide layers at which a latent image is formed.

The production of the emulsion grains according to the first embodiment of the present invention can be attained by combining different methods that are known by themselves, for example, the method of forming tabular grains, the method of depositing silver chloride regions on tabular grains the method of forming shallow electron traps in grains and the method of causing a metal dopant to be contained in grains.

The emulsion containing tabular grains of silver chlorobromide or silver iodobromochloride which is preferred in the first embodiment of the present invention can be prepared by various methods. The preparation of host tabular grain emulsion is generally performed through three basic steps of nucleation, ripening and growth. The terminology "host grain" used herein means silver bromide or silver iodobromide grains onto which silver chloride should be deposited to form the silver chloride region.

With respect to the nucleation steps the use of gelatin having a low methionine content as described in U.S. Pat. No. 4,713,320 and 4,942,120, performing nucleation at a high pBr as described in U.S. Pat. No. 4,914,014 and performing nucleation within a short period of time as described in JP-A-2-222940 are extremely effective in the nucleation step for the tabular grain emulsion preferred in the first embodiment of the present invention.

With respect to the ripening step, performing ripening in the presence of a low-concentration base as described in U.S. Pat. No. 5,254,453 and performing ripening at a high pH as described in U.S. Pat. No. 5,013,641 may, in some cases, be effective in the ripening step for the host tabular grain emulsion of the first embodiment of the present invention. With respect to the growing step, growing at a low temperature as described in U.S. Pat. No. 5,248,587 and the use of silver iodide fine grains as described in U.S. Pat. No. 4,672,027 and 4,693,964 are especially effective in the growing step for the emulsion grains of the first embodiment of the present invention.

In the preparation of the emulsion grains of the first embodiment of the present invention, the silver chloride region is deposited on the host grain surface in an amount of 0.3 to 50 mol % based on the total silver halide of each completed grain after the step of growing the silver bromide or silver iodobromide host grains in the process of forming the silver iodobromide or silver bromide grain emulsion. It is preferred that the above deposition be effected in an amount of 0.5 to 20 mol %, and it is especially preferred that the deposition be effected in an amount of 0.75 to 10 mol %.

The deposition of silver chloride is preferably conducted in the presence of a spectral sensitizing dye.

The deposition site of silver chloride is preferably the outermost surface of the emulsion grains of the first embodiment of the present invention. In this instances although the silver chloride may be uniformly deposited on the entire surface of the host grain to become a outermost surface layer, it is preferred with respect to the tabular grains that centralized or localized deposition be conducted on edge portion or corner portions of the tabular grains. The method of depositing silver chloride regions at specific positions is described in, for examples U.S. Pat. No. 4,463,087.

The silver halide emulsion of the first embodiment of the present invention contains a dopant capable of forming a shallow electron trap to thereby enable increasing a photographic speed. The dopant can be placed in the silver chloride region or any interface between the silver chloride region and a silver iodobromide layer (region) or silver bromide layer (region). When the silver chloride region is not positioned as the outermost surface of each grain, i.e., the silver chloride region is further covered with a silver iodobromide layer or a silver bromide layer, the dopant may be contained in the interface between the silver chloride region and the silver iodobromide layer or silver bromide layer lying inside the silver chloride region, or in the interface between the silver chloride region and the silver iodobromide layer or silver bromide layer lying outside the silver chloride region. It is especially preferred that the dopant be placed in either one of the interfaces between the silver chloride region and the silver iodobromide layer or silver bromide layer.

The terminology "interface" used herein refers to a space ranging from a position 200 angstroms toward the center (inside) of the grains from the site at which the silver chloride region contacts another region (layer) to a position 200 angstroms in a direction opposite to the center of the grains (outside) from the site at which the silver chloride region contacts the other region (layer).

A metal compound with which the emulsion grains used in the first embodiment of the present invention are doped is preferably dissolved in water or a suitable solvent such as methanol or acetone before the doping The method in which an aqueous solution of a hydrogen halide (e.g., HCl or HBr) or an alkali halide (e.g., KCl, NaCl, KBr or NaBr) is added can be employed for stabilizing the solution If necessary, an acid, an alkali and the like can be added to the solution The metal compound can be added either to the reaction vessel before the grain formation or during the grain formation. Further, the metal compound can be put in an aqueous solution of an alkali halide (e.g., aqueous solutions of NaCl, KBr and KI or mixtures of these aqueous solutions) or water-soluble silver salt (e.g., $AgNO_3$) and continuously added during the formation of silver halide grains. Still further, a separate solution from the aqueous solution of an alkali halide and a water-soluble silver salt may be prepared and continuously added over an appropriate period during the grain formation. Such various addition methods may also preferably be combined with each other.

In the first embodiment of the present invention, the silver chloride region may be formed by adding the emulsion of fine silver chloride grains containing the above mentioned metal dopant to the above emulsion of silver iodobromide or silver bromide host tabular grains. In particular, when the silver chloride region is either uniformly deposited around the surface of each host grain to become the outermost layer, or locally deposited at several sections on the surface of each host grain to become the outermost region, such a deposition can be attained by adding fine grains of silver chloride in an after-ripening step (after a desalting step) subsequent to the formation of host grains. The temperature of the system at the time of the above addition is preferably 40 to 90° C. and still preferably 50 to 80° C.

The above emulsion of fine silver chloride grains is preferably prepared by a double-jet method in which an aqueous solution of silver salt and an aqueous solution of chloride salt are added to form grains while keeping the pAg value constant. Herein, pAg is the logarithm of the inverse number of $Ag^+$ ion concentration of the system. Although the temperature, pAg and pH of the system, the type and concentration of protective colloid agent such as gelatin, the presence or absence, type and concentration of silver halide solvent, etc. are not particularly limited, it is preferred in the first embodiment of the present invention that the grain size be not greater than 0.12 $\mu$m especially not greater than 0.10 $\mu$m. The lower limit of the grain size is 0.005 $\mu$m which is a limitation in production. Although the grain configuration cannot completely be specified because of the fineness thereof, it is preferred that the variation coefficient of the grain size distribution be 25%.

The size and size distribution of the emulsion of fine silver chloride grains are determined by placing fine silver chloride grains on a mesh for electron microscope observation and directly observing by the transmission method instead of the carbon replica method. The reason is that the grain size is so small that the measuring error is large in the observation by the carbon replica method. The grain size is defined as the diameter of the circle with a projected area equal to that of the observed grain. The grain size distribution is also determined from the above diameter of the circle with an equal projected area. The fine silver chloride grains which are the most effective in the first embodiment of the present invention have a grain size of 0.08 to 0.10 $\mu$m and have a grain size distribution whose variation coefficient is not greater than 20%.

The amount of silver contained in the layer growing after the formation of the silver chloride region is preferably 0 to 50 provided that the amount of silver contained in the host tabular grain emulsion is 100, more preferably 0 to 30, still more preferably 0 to 10 and most preferably 0.

The halogen composition of the layer growing after the formation of the silver chloride region may be either identical with or different from that of the host grain. Although the temperature, pH and pAg for the formation of this layer are not particularly limited, the employed temperature and pH are generally 40 to 90° C. and 2 to 9, respectively, and preferably 50 to 80° C. and 3 to 7, respectively.

The emulsion grains of the first embodiment of the present invention preferably have dislocation lines. The dislocation lines can be produced by adding KI and $AgNO_3$ solutions or dumping fine grains of AgI during the formation of the grains to thereby cause silver iodide to precipitate on the already formed grain surface, and thus generating a lattice irregularity with the silver halide to be prepared thereafter. The introduction of the dislocation lines contributes to sensitivity enhancement.

The dislocation lines of the tabular grains can be observed by the direct method using a transmission electron microscope at low temperatures as described in, for examples J. F. Hamilton, Phot. Sci. Eng., 11, 57 (1967) and T. Shiozawa, J. Soc. Phot. Sci. Japan, 35, 213 (1972). Illustratively, silver halide grains are harvested from the emulsion with the care that the grains are not pressurized with such a force that dislocation lines occur on the grains, are put on a mesh for electron microscope observation, and observed by the transmission method, while cooling the specimen so as to prevent damaging (printout, etc.) by electron beams. The greater the thickness of the above grains, the more difficult the transmission of electron beams. Therefore, the use of an electron microscope of high voltage type (at least 200 kV for the grains of 0.25 $\mu$m in thickness) is preferred for ensuring clearer observation. The thus obtained photograph of grains enables determining the position and number of dislocation lines with respect to each grain viewed from the direction perpendicular to the.

The grains are provided with an average of, preferably, at least 10 and, more preferably, at least 20 dislocation lines per grain. When dislocation lines are densely present or when dislocation lines are observed in the state of crossing each other, it happens that the number of dislocation lines per grain cannot accurately be counted. However, in this instance as well, rough counting on the order of, for example, 10, 20 or 30 dislocation lines can be effected, so that a clear distinction can be made from the case where only a few dislocation lines exist in a grain. The average number of dislocation lines per grain is determined by counting the number of dislocation lines of each of at least 100 grains and calculating a number average thereof.

Dislocation lines may be positioned either nearly uniformly over the entire zone of the periphery of the tabular grains or may be positioned locally in the periphery. That is, referring to, for example, hexagonal tabular silver halide grains, dislocation lines may be localized either only in the vicinity of six apexes or only in the vicinity of one of the apexes. Contrarily, dislocation lines can be localized only in the sides excluding the vicinity of the six apexes. Moreover, dislocation lines may be localized on the periphery, on the major plane or at local points or a combination thereof. That is, dislocation lines may be present on both the periphery and the major plane.

The second embodiment of the present invention will be described in detail below.

The emulsion of the second embodiment of the present invention of the second embodiment is occupied by tabular silver halide grains having an equivalent circular diameter of 0.1 to 0.6 μm in an amount of at least 70% in number. The terminology "tabular silver halide grains" used herein is a generic designation for silver halide grains having one twin face or at least two mutually parallel twin faces, and silver halide grains having no twin face and having mainly (100) faces as major planes, which silver halide grains are composed of mutually parallel major planes and side faces linking the major planes together.

The terminology "twin face" used herein means (111) faces between both sides of which all lattice point ions are in a mirror image relationship to each other. When viewed from a direction perpendicular to the major planes of the grains, the tabular grains are triangular, hexagonal or circular resulting from rounding of the triangular or hexagonal form. The triangular, hexagonal and circular tabular grains have triangular, hexagonal and circular mutually parallel major planes, respectively.

The terminology "equivalent circular diameter" used herein means the diameter of a circle having an area which is equal to a projected area of the mutually parallel major planes of the grains.

The projected area of the grains can be obtained by measuring the area on an electron micrograph and effecting a magnification correction therefor.

The thickness of the grains can be easily obtained by performing a vapor deposition of a metal on the grains together with a reference latex in a direction oblique thereto, taking an electron micrograph, measuring the length of shadows on the electron micrograph and calculating with reference to the length of the shadow of the latex.

The terminology "aspect ratio of tabular grains" used herein means a quotient of the equivalent circular diameter divided by the thickness of the tabular grains.

In the second embodiment of the present inventions the equivalent circular diameter of the tabular grains is preferably in the range of 0.1 to 0.6 μm, more preferably, 0.2 to 0.6 μm. It is most preferred that the equivalent circular diameter ranges from 0.3 to 0.6 μm. When the equivalent circular diameter of the tabular grains is greater than 0.6 μm, the interlayer effect cannot be satisfactorily regulated.

The thickness of the tabular grains is preferably in the range of 0.03 to 0.5 μm, more preferably, 0.03 to 0.02 μm and, most preferably, 0.03 to 0.10 μm.

Although the aspect ratio of the tabular grains is not particularly limited in the second embodiment of the present invention, it is preferably in the range of 1.2 to 100, more preferably, 1.2 to 50 and, most preferably, 1.3 to 30.

The proportion of the above tabular grains to the emulsion grain of the second embodiment of the present invention is preferably at least 70% based on the number of all the grains of the emulsion. It is more preferably at least 85% and most preferably at least 95% based on the number of all the silver halide grains of the emulsion.

In the second embodiment of the present invention, the tabular grains have a multilayer structure composed of a plurality of layers. When halogen compositions are different between portions of the grains, these portions are termed layers. For example, when each grain is composed of a portion having an iodide content of 20 mol% and a portion having an iodide content of 5 mol %, the grain has a double layer structure. In the second embodiment of the present invention, the core portion of a grain commonly so termed, is also termed a layers although the figure of the core portion is not in layered.

The tabular grains of the second embodiment of present invention have at least one layer which contains a chloride in an amount of 0.4 to 20 mol % based on the amount of silver forming the layer. The chloride content is preferably in the range of 1 to 15 mol %, more preferably, 3 to 10 mol %.

Although the rest of the halogen composition of the chloride-containing layer is arbitrary, both in bromide and iodide contents, the silver iodide content is preferably in the range of 0 to 35 mol %, more preferably, 1 to 20 mol % and, most preferably, 2 to 10 mol %.

The grains used in the emulsion of the second embodiment of the present invention has a silver halide protrusion At least one silver halide protrusion may be deposited on any part of the above tabular grains as a host, i.e., vertex portions, edge portions, major planes and side faces thereof.

It has been found in the second embodiment of the present invention that a surprisingly high sensitization and an interlayer effect having never been attained in the prior art can be realized by causing the silver halide protrusion to deposit on the tabular grains having a chloride-containing layer.

The silver halide protrusion is composed of a silver chloroiodobromide having an iodide-content of 0 to 40 mol %. Although the composition of the silver halide protrusion is arbitrary, the iodide content is preferably in the range of 0.1 to 40 mol %, more preferably, 5 to 30 mol % and, most preferably, 8 to 20 mol %. Further, the chloride content of the silver halide protrusion is preferably in the range of 1 to 99 mol %, more preferably, 5 to 80 mol % and, most preferably, 20 to 60 mol %.

The amount of silver of the silver halide protrusion in each grain based on the amount of silver of each host grain, is preferably in the range of 1 to 30%, more preferably, 1 to 20% and, most preferably, 2 to 10%.

The silver halide protrusion may be formed just after the formation of host tabular grains or may be formed after a water washing step and prior to a chemical ripening.

It may be preferred to add a spectral sensitizing dye to the emulsion of the second embodiment of the present invention during the formation of grains including the formation of seed grains before the water washing step from the viewpoint that high sensitivity is attained. If necessary, a spectral sensitizing dye can be supplemented after the water washing step, that is, prior to or after a chemical ripening.

Although the total amount of spectral sensitizing dye to be added during the preparation of the silver halide emulsion depends on the type of the sensitizing dye, the amount of silver halides etc. and cannot be universally specified, the spectral sensitizing dye can preferably be used in an amount of 50 to 150% based on the saturated coating amount of emulsion grains.

That is, the spectral sensitizing dye is generally $1\times10^{-5}$ mol to $1\times10^{-2}$ mol, preferably added in an amount of 0.001 to 100 mmol, more preferably, 0.01 to 10 mmol per mol of silver halide.

The saturated coating amount of emulsion grains can be determined by the method described in Journal of Chemical Society of Japan, No. 6, 942 (1984).

The emulsion of the second embodiment of the present invention may contain a dye which itself exerts no spectral sensitizing effect or a substance which absorbs substantially none of visible radiation and exhibits supersensitization, together with the above spectral sensitizing dye. For examples the emulsion of the second embodiment of the present invention may contain any of aminostyryl compounds substituted with a nitrogen-containing heterocyclic group (e.g., described in U.S. Pat. Nos. 2,933,390 and 3,635,721), aromatic organic acid formaldehyde condensates (e.g., described in U.S. Pat. No. 3,743,510), cadmium salts and azaindene compounds. Combinations described in U.S. Pat. Nos. 3,615,613, 3,615,641, 3,617,295 and 3,635,721 are especially useful.

In the second embodiment of the present inventions it is preferred that the silver iodide content of the outermost layer of the tabular grains be at least 3 mol % based on the amount of silver contained in the outermost layer. The silver iodide content is more preferably in the range of 5 to 30 mol %, most preferably, 10 to 20 mol %. In the second embodiment of the present invention, the above chloride-containing layer may be the outermost layer of the grains.

The structure of the halogen composition of the grains for use in the second embodiment of the present invention can be confirmed by a combination of, for example, X-ray diffractometry, analytical transmission electron microscope (analytical TEM), EPMA (also known as XMA, the method in which silver halide grains are scanned by electron beams to thereby detect the silver halide composition) and ESCA (also known as XPS, the method in which grains are irradiated with X rays and photoelectrons emitted from the grain surface are spectrally analyzed).

Although the relative standard deviation of intergranular silver iodide distribution or silver chloride distribution of the silver halide emulsion of the second embodiment of the present invention is not particularly limited, it is preferably not greater than 50%, more preferably, not greater than 35% and, most preferably, not greater than 20%.

The halogen content of each individual emulsion grain can be measured by analyzing the composition of each grain with the use of, for example, an X-ray microanalyzer. The terminology "relative standard deviation of halogen content of each individual grain" used herein means, for example, a value determined by, referring to an example in which the halogen is iodine, dividing the standard deviation of iodide content obtained by measuring the iodide contents of at least 100 emulsion grains with the use of an X-ray microanalyzer by an average iodide content and multiplying the obtained quotient by 100. Particular procedure for measuring the halogen content of each individual emulsion grain is described in, for example, EP 147,868A.

When the relative standard deviation of halogen content of each individual grain is large, suitable points for chemical sensitization are different among individual grains and it becomes impracticable to bring out all photographic capabilities including sensitivity, pressure properties, shelf life and processability possessed by all the emulsion grains. Further, the intergranular relative standard deviation of number of dislocations also tends to increase.

Although according to cases, there is a correlation or no correlation between the halogen content Yi (mol %) of each individual grain and the equivalent spherical diameter Xi (micron) of each grain, it is preferred that no correlation exist.

More desirable results may be obtained by the use of monodispersed tabular grains. The structure of monodispersed tabular grains and the process for producing the same are as described in, for example, JP-A-63-151618. A brief description of the configuration thereof is as follows. Tabular silver halide grains whose major plane is shaped like a hexagon having a ratio of the length of the side with the largest length to the length of the side with the smallest length of not greater than 2 and which has two mutually parallel planes as major planes, accounts for at least 70% of the total projected area of the silver halide grains. Moreover, the hexagonal tabular silver halide grains are so monodispersed as to exhibit a variation coefficient of grain size distribution, i.e., a quotient of grain size variation (standard deviation) expressed by the equivalent circular diameter of the projected area thereof divided by an average grain size, of not greater than 20%.

Causing a salt of metal ion to be present during the preparation of the emulsion of the present invention, for example, during the grain formations desilvering or chemical sensitization or prior to coating is preferred depending on the object. In case the salt of metal ion is to be doped in the grains, the metal ion salt is preferably added during the grain formation. In case the salt of the metal ion is used for the modification of grain surface or to be used as a chemical sensitizer, the metal ion salt is preferably added after the grain formation but before the completion of chemical sensitization. A selection can be made from among a method in which doping is conducted on the entirety of the grains and a method in which doping is conducted on only part of the grain constituting phase, such as core portion, shell portion, outermost layer, protrusion portion or base grain.

Examples of suitable metals include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi.

These metals can be added as long as they are in the form of a salt enabling dissolution during the grain formation, such as an ammonium salt, an acetate, a nitrate, a sulfate, a phosphate, a hydroxide, a hexacoordinated complex salt or a tetracoordinated complex salt. For example, suitable examples of such salts include $CdBr_2$, $CdCl_2$, $Cd(NO_3)_2$, $Pb(No_3)_2$, $Pb(CH_3COO)_2$, $K_3[Fe(CN)_6]$, $(NH_4)_4[Fe(CN)_6$, $K_3IrCl_6$, $(NH_4)_3RhCl_6$ and $K_4Ru(CN)_6$. Coordination compound ligands can be selected from among halo, aquo, cyano, cyanate, thiocyanate, nitrosyl, thionitrosyl, oxo and carbonyl. The above metal compounds may be used either individually or in combination.

The metal compound can be added to the emulsion of the second embodiment of the present invention in the same manner as to the emulsion of the first embodiment of the invention.

Further in the second embodiment of the present invention, the use of tabular grains having dislocation lines introduced therein may be still preferred.

The dislocation lines can be observed in the same manner as described in the first embodiment of the present invention.

The dislocation of the tabular grains is positioned in the zone extending from a distance of x % of the length from the center to the side to the side along the direction of the major axis of the tabular grains. This x preferably satisfies the relationship $10 \leqq x < 100$, more preferably, $30 \geqq x < 98$ and, most preferably, $50 \geqq x < 95$. The configuration created by tying positions at which the dislocation begins is nearly similar to the grain form but is not a completely similar form and may be slightly twisted. The terminology "direction of major axis" used herein means the direction which is parallel to the principal planes. The direction of a dislocation line nearly agrees with the direction oriented from the center to the side but is often zigzagged.

With respect to the number of dislocations of the tabular grains, it is preferred that grains having 5 to 100 dislocations per grain account for at least 50% (in number) of the tabular grains. In the presence of a multiplicity of dislocation lines, it may occur that the dislocation lines overlap each other to thereby disenable accurate counting thereof. More preferably, grains having at least 5 dislocations per grain account for at least 80% (in number) of the tabular grains and, most preferably, grains having at least 10 dislocations per grain account for at least 80% (in number) of the tabular grains.

The emulsion of the second embodiment of the present invention can suitably be used as an emulsion of a light-sensitive emulsion layer for use in silver halide photographic lightsensitive materials. The type of the emulsion layer is not particularly limited as long as the layer is lightsensitive, and the emulsion of the invention use be used in any of green-sensitive, red-sensitive and blue-sensitive emulsion layers.

The process for producing tabular grains for use in the second embodiment of the present invention will be described below.

The tabular grains for use in the second embodiment of the present invention can be prepared according to processes improved from those described in, for examples Clever Photography Theory and Practice (1930), page 13; Gutuff, Photographic Science and Engineering, vol. 14, p.p. 248–257 (1970); U.S. Pat. Nos. 4,434,226, 4,414,310, 4,433,048 and 4,439,520; and BP 2,112,157.

The silver halide composition of the grains for use in the second embodiment of the present invention is silver chlorobromide, silver chloroiodide or silver chloroiodobromide. Other silver salts such as silver rhodanide, silver sulfide, silver selenide, silver carbonate, silver phosphate and organic acid salts of silver may be contained therein as separate grains or part of the silver halide grains. When expedition of the developing and desilvering steps (bleach, fixation and bleach-fix) is desired, it is preferred to employ silver halide grains having a high silver chloride content. When an appropriate inhibition of the development is desired, it is preferred to employ silver halide grains containing silver iodide. Suitable silver iodide content depends on the type of desired lightsensitive material. For example, the silver iodide content preferably ranges from 0.1 to 15 mol % in X-ray sensitive materials and preferably ranges from 0.1 to 5 mol % in graphic arts and micro lightsensitive materials. With respect to lightsensitive materials for photographing represented by color negatives, the silver halide grains preferably contain 1 to 30 mol % of silver iodide.

It is important to control the halogen composition in the vicinity of the surface of the grains (outermost layer). Increasing the silver iodide content or silver chloride content in the vicinity of the surface of the grains can vary the adsorption property of the grain to a dye and the development speed, so that a selection thereon can be made in accordance with the object. When the halogen composition is changed in the vicinity of the surface of the grains, a selection of the grain structure can be made from among a structure in which the entirety of the grains is enclosed and a structure in which an attachment is effected to only part of the grains.

The quotient of the equivalent circular diameter of the projected area divided by the grain thickness is termed the aspect ratio, which defines the configuration of the tabular grains. The tabular grains having an aspect ratio of at least 1.1 are used in the second embodiment of the present invention The tabular grains can be prepared by any of the processes described in, for example, Cleve, Photography Theory and Practice (1930), page 131; Gutuff, Photographic Science and Engineering, vol. 14, p.p. 248–257 (1970); U.S. Pat. Nos. 4,434,226, 4,414,310, 4,433,048 and 4,439,520; and BP 2,112,157.

Occasionally, preferred use is made of the process comprising previously putting precipitated silver halide grains in a reactor vessel for emulsion preparation as described in U.S. Pat. Nos. 4,334,012, 4,301,241 and 4,150,994. The grains can be used as seed crystals and are suitable for being fed as silver halide for growing. In the latter case, an emulsion of small grain size is preferably added by a method selected from among adding the whole amount once, adding a plurality of divisions in sequence and continuous addition. Moreover, occasionally, adding grains of various halogen compositions for surface modification is also useful.

Processes for converting most or only part of the halogen composition of silver halide grains by the halogen conversion technique are disclosed in, for example, U.S. Pat. Nos. 3,477,852 and 4,142,900, EP 273,429 and 273,430 and West German Patent Laid-open No. 3,819,241, which provide an effective grain forming technique. A solution of soluble halogen or silver halide grains can be added in order to convert the silver salt of the grain to another silver salt whose solubility is more sparing. The conversion can be effected by a method selected from among one-time conversion, divided conversions and continuous conversion.

Preferred use is made of the grain forming method which involves concentration changes and flow rate changes as described in BP 1,469,480 and U.S. Pat. Nos. 3,650,757 and 4,242,445 as well as the above method in which the grain growth is conducted by adding soluble silver salt and halide at a constant concentration and a constant flow rate. The amount of fed silver halide can be changed in a linear or quadric function or a more complex function of addition time by increasing the concentration or the flow rate. Occasionally, it is preferred to decrease the amount of fed silver halide if necessary. Moreover, when a plurality of soluble silver salts which are different from each other in solution composition or a plurality of soluble halides which are different from each other in solution composition are added, an effective addition method comprises increasing one component and decreasing another component.

The mixer employed in the reaction of a solution of soluble silver salt with a solution of soluble halide salt can be selected from among those employed in the processes described in U.S. Pat. Nos. 2,996,287, 3,342,605, 3,415,650 and 3,785,777 and West German Patent Laid-open Nos. 2,556,885 and 2,555,364.

Silver halide solvents are useful for the purpose of promoting the ripening. For example, it is known to cause excess halide ions to be present in the reactor for the purpose of promoting the ripening. Other ripening agents can also be used. The whole amount of this ripening agent can be added to the dispersion medium of the reactor prior to the addition of silver and halide salts. Alternatively, the ripening agent can be introduced in the reactor simultaneously with the addition of halide, silver salts or a defloccurant. In still another modified mode, the ripening agent can independently be introduced at the stage of adding the halide salt and silver salt.

Examples of suitable ripening agents include ammonia, thiocyanates (e.g., potassium and ammonium rhodanides), organic thioether compounds (e.g., compounds described in U.S. Pat. Nos, 3,574,628, 3,021,215, 3,057,724, 3,038,805, 4,276,374, 4,297,439, 3,704,130 and 4,782,013 and JP-A-57-104926), thione compounds (e.g., tetrasubstituted thioureas described in JP-A-53-82408 and 55-77737 and U.S. Pat. No. 4,221,863 and compounds described in JP-A-53-144319), mercapto compounds capable of promoting the growth of silver halide grains described in JP-A-57-202531 and amine compounds (e.g., JP-A-54-100717).

Although gelatin is advantageous for use as a protective colloid employed in the preparation of the emulsion of the first and the second embodiments of the present invention and as a binder for other hydrophilic colloid layer, use also can be made of other hydrophilic colloids.

For example, use can be made of various synthetic hydrophilic polymeric materials including proteins such as gelatin derivatives, graft polymers of gelatin and other polymers, albumin and casein; sugar derivatives, for example, cellulose derivatives such as hydroxyethylcellulose, carboxymethylcellulose and cellulose sulfate, sodium alginate and starch derivatives; and various synthetic hydrophilic homo or copolymers such as polyvinyl alcohol, partially acetalized polyvinyl alcohol, poly-N-vinylpyrrolidone, polyacrylic acid, polymethacrylic acid, polyacrylamide, polyvinylimidazole and polyvinylpyrazole.

Suitable gelatins include, for example, not only lime treated gelatins and acid treated gelatins but also enzyme treated gelatins as described in Bull. Soc. Sci. Photo. Japan, No. 16, p. 30 (1966). Also, use can be made of gelatin hydrolyzates and enzymolyzates.

The emulsion of the first and the second embodiments of the present invention is preferably washed with water for desalting and formed into a dispersion with newly provided protective colloid. The water washing is conducted at temperatures selected so as to meet the object, preferably selected within the range of 5 to 50° C. Although the pH in which the water washing is conducted can also be selected in accordance with the object, it is preferably selected within the range of 2 to 10, more preferably within the range of 3 to 8. Although the pAg in which the water washing is conducted can also be selected in accordance with the object, it is preferably selected within the range of 5 to 10. The method of water washing can be selected from the noodle water washing technique, the dialysis technique using semipermeable membrane, the centrifugation, the coagulation sedimentation method and the ion exchange method. The coagulation precipitation can be conducted according to a method selected from the method in which a sulfate is used, the method in which an organic solvent is used, the method in which a water soluble polymer is used and the method in which a gelatin derivative is used.

It may be useful to add a chalcogenide compound as described in U.S. Pat. No. 3,772,031 to the emulsion during the preparation thereof. Not only S, Se and Te but also a cyanate, a thiocyanate, selenocyanic acid, a carbonate, a phosphate and an acetate may be contained therein.

In any of the steps of the silver halide emulsion preparation process, the silver halide grains used in the first and the second embodiments of the present invention can be provided with at least one of sulfur sensitization, selenium sensitization, noble metal sensitization such as gold or palladium sensitization and reduction sensitization. Sensitization is preferably performed by a combination of at least two of these sensitization.

Various types of emulsions can be prepared depending on in which of the steps the chemical sensitization is carried out. These include the type in which a chemical sensitization nucleus is implanted in an inner portion of the grains, the type in which the implantation is performed in a site shallow from the grain surface and the type in which the chemical sensitization nucleus is set in the grain surface. In the emulsion of the first and the second embodiments of the present invention, although the position of the chemical sensitization nucleus can be selected depending on the object, it is generally preferred that at least one chemical sensitization nucleus be provided in the vicinity of the grain surface.

One chemical sensitization which can preferably be carried out in the first and the second embodiments of the present invention is each or a combination of the chalcogenide sensitization and the noble metal sensitization. The chemical sensitizations can be performed by using active gelatin as described in T. H. James, The Theory of the Photographic Process, 4th ed., Macmillan, 977, p.p 67–76.

Also, the chemical sensitization can be performed by using a sensitizer selected from sulfur, selenium, tellurium, gold, platinum, palladium, iridium and combinations thereof at a pAg of 5 to 10, a pH of 5 to 8 and a temperature of 30 to 80° C. as described in Research Disclosure, vol. 120, Apr. 1974, 12008, Research Disclosure, vol. 34, Jun. 1975, 13452, U.S. Pat. Nos. 2,642,361, 3,297,446, 3,772,031, 3,857,711, 3,901,714, 4,266,018 and 3,904,415 and British Patent (hereinafter referred to as B. P.) 1,315,755.

In the noble metal sensitization, salts of noble metals such as gold, platinum, palladium and iridium can be used and, especially, the gold sensitization, palladium sensitization and a combination thereof are preferred.

In the gold sensitization, known compounds such as chloroauric acid, potassium chloroaurate, potassium auriothiocyanate, gold sulfide and gold selenide, can be used.

The palladium compound means divalent and tetravalent palladium salts. Preferred palladium compounds are represented by the formula:

$$R_2PdX_6 \text{ or } R_2PdX_4$$

wherein R is a hydrogen atom, an alkali metal atom or an ammonium group and X is a halogen atom selected from chlorine, bromine and iodine atoms.

Specifically, $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$ are preferred. The gold compound and palladium compound are preferably used in combination with a thiocyanate salt or a selenocyanate salt.

Suitable sulfur sensitizers include hypo, thiourea compounds, rhodanine compounds and sulfurous compounds described in U.S. Pat. Nos. 3,857,711, 4,266,018 and 4,054,457.

Chemical sensitization can be effected in the presence of a chemical sensitization auxiliary commonly so termed. Suitable chemical sensitization auxiliaries are the compounds that are known to be capable of inhibiting fog in the course of chemical sensitization and capable of increasing sensitivity, such as azaindene, azapyridazine and azapyrimidine. Examples of chemical sensitization auxiliary modifiers are set forth in U.S. Pat. Nos. 2,131,038, 3,411,914 and 3,554,757, JP-A-58-126526 and the above mentioned Duffin, "Chemistry of Photographic Emulsion", p.p. 138–143.

The emulsion of the first and the second embodiments of the present invention is preferably used in combination with the gold sensitization The gold sensitizer is preferably added in an amount of $1\times10^{-4}$ to $1\times10^{-7}$ mol, more preferably, $1\times10^{-5}$ to $5\times10^{-7}$ mol per mol of silver halide in an emulsion.

Preferred amount of the palladium compound ranges from $1\times10^{-3}$ to $5\times10^{-7}$ mol per mol of silver halide in an emulsion. Preferred amount of the thiocyanate compound or selenocyanate compound ranges from $5\times10^{-2}$ to $1\times10^{-6}$ mol per mol of silver halide in an emulsion.

The preferred amount of sulfur sensitizer added in the silver halide grains for use in the first and the second embodiments of the present invention is $1\times10^{-4}$ to $1\times10^{-7}$ mol, still preferably, $1\times10^{-5}$ to $5\times10^{-7}$ mol per mol of silver halide in an emulsion.

The selenium sensitization can preferably be performed as chemical sensitization for the emulsion of the first and the second embodiments of the present invention. In the selenium sensitizations known unstable selenium compounds, for example, colloidal metal selenium, selenoureas (e.g., N,N-dimethylselenourea and N,N-diethylselenourea) selenoketones, selenoamides and other selenium compounds, can be used. It may be preferred that the selenium sensitization be employed in combination with either or both of the sulfur sensitization and noble metal sensitization. Most preferably, the selenium sensitization is employed in combination with both of the sulfur sensitization and noble metal sensitization.

The silver halide emulsion of the first and the second embodiments of the present invention is preferably subjected to a reduction sensitization during the grain formation, or before, during or after a chemical sensitization that is performed after the grain formation.

The reduction sensitization can be effected according to a method selected from the method in which a reduction sensitizer is added to the silver halide emulsion, the method commonly known as silver ripening in which grains are grown or ripened in an environment of pAg as low as 1 to 7 and the method commonly known as high-pH ripening in which grains are grown or ripened in an environment of pH as high as 8 to 11. At least two of these methods can be used in combination.

The method in which a reduction sensitizer is added is preferred from the viewpoint that the level of reduction sensitization can be finely regulated.

Known examples of suitable reduction sensitizers include stannous salts, ascorbic acid and its derivatives amines and polyamines, hydrazine derivatives, formamidinesulfinic acid, silane compounds and borane compounds. In the reduction sensitization of the first and the second embodiments of the present invention, one of these known reduction sensitizers can be selected from the above conventional reduction sensitizers and used or at least two may be selected from these known reduction sensitizers and used in combination. Preferred reduction sensitizers are stannous chloride, thiourea dioxide, dimethylaminoborane, ascorbic acid and derivatives thereof. Since the addition amount of the reduction sensitizer depends on the manufacturing conditions, the amount must be so selected as to meet the emulsion manufacturing conditions. It is generally preferred that the addition amount ranges from $10^{-7}$ to $10^{-3}$ mol per mol of the silver halide in an emulsion.

The reduction sensitizer is dissolved in water or any of solvents such as alcohols, glycols, ketones, esters and amides and is added during the grain growth. Although the reduction sensitizer may be put in a reactor vessel in advance, it is preferred that the addition be effected at an appropriate time during the grain growth. It is also suitable to add in advance the reduction sensitizer to an aqueous solution of a water-soluble silver salt or a water-soluble alkali halide and to precipitate silver halide grains with the use of the aqueous solutions. The reduction sensitizer solution may preferably be either divided and added in a plurality of times in accordance with the growth of grains or continuously added over a prolonged period of time.

An oxidizer capable of oxidizing silver is preferably added to the emulsion of the first and the second embodiments of the present invention during the process of producing the same. The silver oxidizer is a compound having an effect of acting on metallic silver to thereby convert the same to silver ion. A particularly effective compound is one that converts very fine silver grains formed as a by-product in the process of formation of silver halide grains and the process of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be either an inorganic or organic substance Examples of suitable inorganic oxidizers include ozone, hydrogen peroxide and its adducts (e.g., $NaBO_2\cdot H_2O_2\cdot 3H_2O$, $2NaCO_3\cdot 3H_2O_2$, $Na_4P_2O_7\cdot 2H_2O_2$ and $2Na_2SO_4\cdot H_2O_2\cdot 2H_2O$), peroxy acid salts (e.g., $K_2S_2O_8$, $K_2C_2O_6$ and $K_2P_2O_8$), peroxy complex compounds (e.g., $K_2\{Ti(O_2)C_2O_4\}\cdot 3H_2O$, $4K_2SO_4\cdot Ti(O_2)OH\cdot SO_4\cdot 2H_2O$ and $Na_3\{VO(O_2)(C_2H_4)_2\}\cdot 6H_2O$), permanganates (e.g., $KMnO_4$), oxyacid salts such as chromates (e.g., $K_2Cr_2O_7$), halogen elements such as iodine and bromine, perhalogenates (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid and active halogen-releasing compounds (e.g., N-bromosuccinimide, chloramine T and chloramine B).

Oxidizers preferred in the first and the second embodiments of the present invention are inorganic oxidizers of ozone, hydrogen peroxide and its adducts, halogen elements and thiosulfonates, and organic oxidizers of quinones. The use of the silver oxidizer in combination with the above reduction sensitizer is preferred. This combined use can be effected by performing the reduction sensitization after the use of the oxidizer or vice versa or by simultaneously performing the reduction sensitization and the use of the oxidizer. These methods can be selectively performed during the grain formation or chemical sensitization.

Although the emulsion of the first and the second embodiments of the present invention may be of any of the surface latent image type in which the latent image is mainly formed at the surface, the internal latent image type in which the latent image is mainly formed within the grains and the type in which the latent image is formed both at the surface and within the grains, the emulsion of the present invention must be of the negative type. The emulsion of the internal latent image type may be, for example, one of the core/shell internal latent image type described in JP- A-63-264740. The process for producing this emulsion of the core/shell internal latent image type is described in JP-A-59-133542. Although the shell thickness of this emulsion depends on development conditions, etc., it preferably ranges from 3 to 40 nm, more preferably, from 5 to 20 nm.

To the photographic emulsion of the first and the second embodiments of the present invention various compounds can be added for the purpose of preventing fogs that occur during the process for producing the lightsensitive material or during the storage or during photographic processing thereof or for the purpose of stabilizing the photographic performance. That is, to the emulsion of the first and the second embodiments of the present invention, various compounds known as antifoggants or stabilizers can be added, which include thiazoles (e.g., benzothiazolium salts), nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nirobenzotriazoles, mercaptotetrazoles (especially, 1-phenyl-5-mercaptotetrazole), mercaptopyrimidines, mercaptotriazines (e.g., thioketo compounds such as oxazolinethione), and azaindenes such as triazaindenes, tetraazaindenes (especially, 4-hydroxy substituted (1,3,3*a*, 7)tetraazaindenes) and pentaazaindenes. For example, use can be made of those described in U.S. Pat. Nos. 3,954,474 and 3,982,947 and Jpn. Pat. Appln. KOKOKU Publication No. (hereinafter referred to as JP-B-) 52-28660.

Some of the preferred compounds are those described in JP-A-63-212932. The antifoggant or stabilizer can be added at a varied time, for example, before, during or after the grain formation, during the washing step with water, at dispersing step after the water washing, before, during or after the chemical sensitizations or before the coating, in accordance with the purpose. The addition of the above compounds during emulsion preparation can be performed not only for the above exertion of intended fog prevention and stabilizing effects but also for a multiplicity of other purposes including control of the crystal habit of grains, decrease of the grain sizes lowering of the grain solubility, control of the chemical sensitization and control of the dye arrangement.

The photographic emulsion of the first and the second embodiments of the present invention is preferably spectrally sensitized with a methine dye or the like from the viewpoint that the effects desired in the first and the second embodiments of the present invention can be exerted.

Examples of employed dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are any of those belonging to cyanine dyes, merocyanine dyes and composite merocyanine dyes. Any of nuclei commonly used in cyanine dyes as basic heterocyclic nuclei can be applied to these dyes. Examples of such applicable nuclei include a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have a substituent on a carbon atom thereof.

Any of 5 or 6 membered heterocyclic nuclei such as a pyrazolin-5-one nucleus, a thiohydantoin nucleus, a 2-thioxazolidine-2,4-dione nucleus, a thiazolidine-2,4-dione nucleus, a rhodanine nucleus and a thiobarbituric acid nucleus can be applied as a nuclei having a ketomethylene structure to the merocyanine dye or composite merocyanine dye.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609 3,837,862, 4,026,707, B. P. 1,344,281 and 1,507,803, JP-B-43-4936 and 53-12375 and JP-A-52-110618 and 52-109925. The spectral sensitizing dye can generally be added in an amount of $1\times10^{-5}$ to $1\times10^{-2}$ mol/mol Ag.

To the emulsion of the first and the second embodiments of the present invention a dye may be added, which itself exerts no spectral sensitizing effect or a substance which absorbs substantially none of visible radiation and exhibits supersensitization, together with the above spectral sensitizing dye.

The spectral sensitizing dye may be added to the emulsion at any stage of the process for preparing the emulsion which is known as being useful. Although the addition is most usually performed at a stage between the completion of the chemical sensitization and the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be performed prior to the chemical sensitization as described in JP-A-58-113928 and, also, the spectral sensitizing dye can be added prior to the completion of silver halide grain precipitation to thereby initiate the spectral sensitization Further, the above compound can be divided prior to addition, that is, part of the compound can be added prior to the chemical sensitization with the rest of the compound added after the chemical sensitization as taught in U.S. Pat. No. 4,225,666. Still further, the spectral sensitizing dye can be added at any stage during the formation of silver halide grains ranging from the method disclosed in U.S. Pat. No. 4,183,756 to other methods.

The spectral sensitizing dye can be added in an amount of $4\times10^{-6}$ to $8\times10^{-3}$ mol per mol of silver halide. When the silver halide grain size is in the preferred range of 0.2 to 1.2 $\mu$m, the doping in an amount of about $5\times10^{-5}$ to $2\times10^{-3}$ mol is more effective.

With respect to various techniques and organic and inorganic substances which can be employed in the photographic silver halide emulsion of the first and the second embodiments of the present invention and the silver halide photographic lightsensitive material using the emulsion, use can generally be made of those described in Research Disclosure No. 308119 (1989) and No. 37038 (1995).

In addition, specifically, techniques and organic and inorganic substances which can be used in the color photographic lightsensitive material in which the photographic silver halide emulsion of the first and the second embodiments of the present invention can be used are described in the following portions of EP 436,938A2 and the patents cited below 1. Yellow coupler: page 137, line 35 to page 146, line 33 and page 149, lines 21 to 23
2. Magenta coupler: page 149, lines 24 to 28. EP 421, 453A1, page 3, line 5 to page 25, line 55
3. Cyan coupler: page 149, lines 29 to 33. EP 432,804A2, page 3, line 28 to page 40, line 2
4. Polymer coupler: page 149, lines 34 to 38; EP 435, 334A2, page 113, line 39 to page 123, line 37
5. Colored coupler: page 53, line 42 to page 137, line 34 and page 149, lines 39 to 45
6. Other functional couplers: page 7, line 1 to page 53, line 41 and page 149, line 46 to page 150, line 3, EP 435,334A2, page 3, line 1 to page 29, line 50
7. Antiseptic and mildewproofing agents: page 150, lines 25 to 28
8. Formalin scavenger: page 149, lines 15 to 17
9. Other additives: page 153, lines 38 to 47; EP 421, 453A1, page 75, line 21 to page 84, line 56 and page 27, line 40 to page 37, line 40
10. Dispersion method: page 150, lines 4 to 24
11. Support: page 150, lines 32 to 34

12. Thickness/properties of film: page 150, lines 35 to 49

13. Color development, black and white development, and fogging steps: page 150, line 50 to page 151, line 47. EP 442,323A2, page 34, lines 11 to 54 and page 35, lines 14 to 22

14. Desilvering step: page 151, line 48 to page 152, line 53

15. Automatic processor: page 152, line 54 to page 153, line 2

16. Washing with water and stabilization steps: page 153, lines 3 to 37.

17. Layer configuration of the photographic material: page 146, line 34 to page 147, lines 25.

18. Silver halide emulsion that can be used in combination: page 147, line 26 to page 148, line 12.

EXAMPLES

The present invention will be described in more detail below by way of its examples. However, the present invention is not limited to these examples.

EXAMPLE 1

Preparation of Emulsion Em-a 0.9 g of potassium bromide, 50 g of inactive gelatin and 4.5 g of ammonium nitrate were dissolved in 1L of distilled water. While agitating the resultant aqueous solution well, 17.4 mL of 1N sodium hydroxide was added thereto. A 2.7% aqueous potassium bromide solution containing 0.16 g of potassium iodide in 100 mL thereof and a 4% aqueous silver nitrate solution were added by a double jet method over a period of 10 min while holding the temperature at 72° C. and holding the pAg at 7.1 (10% of the total silver amount was consumed by this addition (1)). Subsequently, a 13.5% aqueous potassium bromide solution containing 0.8 g of potassium iodide in 100 mL thereof and a 20% aqueous silver nitrate solution were added to the resultant mixture by a double jet method over a period of 37 min while holding the temperature at 72° C. and holding the pAg at 6.9 (70% of the total silver amount was consumed by this addition (2)). Further, a 13.5% aqueous potassium bromide solution containing 0.8 g potassium iodide in 100 mL thereof and a 20% aqueous silver nitrate solution were added to the resultant mixture by a double jet method over a period of 10 min while holding the temperature at 72° C. and holding the pAg at 7.4 (20% of the total silver amount was consumed by this addition (3)). Thereafter, the resultant emulsion was washed with water at 35° C. by using a known flocculation method, gelatin was added and the pH and pAg were adjusted to 5.7 and 8.6, respectively at the temperature of 40° C. Thus, there was obtained cubic AgBrI (AgI=4.0 mol %) emulsion Em-a having an average grain diameter of 0.40 μm.

Preparation of Emulsion Em-b

The amount of iodine was increased in the steps (2) and (3) of the preparation of emulsion Em-a so that the AgI concentration of the whole grains became 15 mol %, thereby obtaining emulsion Em-b. The emulsion Em-b was cubic AgBrI (AgI=15.0 mol %) emulsion having an average grain diameter of 0.41 μm.

Preparation of Emulsion Em-c

Emulsion Em-c was prepared in the same manner as emulsion Em-a except that, after the addition of the 13.5% aqueous potassium bromide solution containing 0.8 g of potassium iodide in 100 mL thereof (hereinafter in Example 1, referred to as "KBr SOLUTION") advanced by 50% in the step (3), SET-2 was homogeneously added with the use of the KBr SOLUTION in an amount equivalent to $2\times10^{-5}$ mol/mol Ag (molar amount per mol of completed grains). The emulsion Em-c was cubic AgBrI (AgI=4.0 mol %) grain emulsion having an average grain diameter of 0.40 μm.

Preparation of Emulsion Em-d

Emulsion Em-d was prepared in the same manner as emulsion Em-a except that SET-2 was homogeneously added with the use of the KBr SOLUTION in an amount equivalent to $2\times10^{-5}$ mol/mol Ag immediately upon completion of the step (2). The emulsion Em-d was cubic AgBrI (AgI=4.0 mol %) grain emulsion having an average grain diameter of 0.40 μm.

Preparation of Emulsion Em-e

Emulsion Em-e was prepared in the same manner as emulsion Em-b except that SET-2 was homogeneously added with the use of the KBr SOLUTION in an amount equivalent to $2\times10^{-5}$ mol/mol Ag after the addition of the KBr SOLUTION of the step (3) advanced by 50%. The emulsion Em-e was cubic AgBrI (AgI=15.0 mol %) grain emulsion having an average grain diameter of 0.41 μm.

Preparation of Emulsion Em-f

Emulsion Em-f was prepared in the same manner as emulsion Em-c except that a NaCl solution (equivalent to 2 mol %) was added after the completion of the step (2). followed by addition of a $AgNO_3$ solution (equivalent to 2 mol %), and SET-2 was homogeneously added with the use of the KBr SOLUTION in an amount equivalent to $2\times10^{-5}$ mol/mol Ag after the addition of the KBr SOLUTION of the step (3) advanced by 50% so that the total silver amount became the same as that of emulsion Em-c. The emulsion Em-f was cubic AgClBrI (AgI=4.0 mol%, AgCl=2.0 mol %) grain emulsion having an average grain diameter of 0.40 μm.

Preparation of Emulsion Em-g

Emulsion Em-g was prepared in the same manner as emulsion Em-c except that a NaCl solution (equivalent to 2 mol %) was added after the completion of the step (2), followed by addition of a $AgNO_3$ solution (equivalent to 2 mol %), and immediately thereafter SET-2 was added in an amount equivalent to $2\times10^{-5}$ mol/mol Ag with the remaining operation of the step (3) continued in the same manner as in the preparation of emulsion Em-c so that the total silver amount became the same as that of emulsion Em-c. The emulsion Em-g was cubic AgClBrI (AgI=4.0 mol %, AgCl=2.0 mol %) grain emulsion having an average grain diameter of 0.40 μm.

Preparation of Emulsion Em-h

Emulsion Em-h was prepared in the same manner as emulsion Em-b except that a NaCl solution (equivalent to 2 mol %) was added after the completion of the step (2), followed by addition of a $AgNO_3$ solution (equivalent to 2 mol %), and immediately thereafter SET-2 was homogeneously added with the use of the KBr SOLUTION in an amount equivalent to $2\times10^{-5}$ mol/mol Ag with the remaining operation of the step (3) continued in the same manner as in the preparation of emulsion Em-b so that the total silver amount became the same as that of emulsion Em-b. The emulsion Em-h was cubic AgClBrI (AgI=15.0 mol %, AgCl=2.0 mol %) emulsion having an average grain diameter of 0.41 μm.

Preparation of Emulsion Em-i

Tabular emulsion (average aspect ratio:4.5) having the same silver halide composition as that of emulsion Em-d was prepared and designated emulsion Em-i. In the preparation of emulsion Em-i, SET-2 was homogeneously added with the use of the KBr SOLUTION in an amount equivalent to $2\times10^{-5}$ mol/mol Ag immediately after the formation of the silver chloride layer in the same manner as in the preparation of emulsion Em-d.

Preparation of Emulsion Em-j

Emulsion Em-j was obtained in the same manner as emulsion Em-i except that SET-1 was used as the dopant metal.

Preparation of Emulsion Em-k

Emulsion Em-k was obtained in the same manner as emulsion Em-i except that SET-5 was used as the dopant metal.

Preparation of Emulsion Em-1

Emulsion Em-1 was obtained in the same manner as emulsion Em-a except that the amount of iodine was increased in the steps (2) and (3) so that the AgI content of the entire grain was 7 mol %. The emulsion Em-1 was cubic AgBrI (AgI=7.0 mol %) emulsion having an average grain diameter of 0.40 $\mu$m.

Preparation of Emulsion Em-m

Emulsion Em-m was prepared in the same manner as emulsion Em-a except that a NaCl solution (equivalent to 2 mol %) was added after the completion of the step (2), followed by addition of a $AgNO_3$ solution (equivalent to 2 mol %), and immediately thereafter SET-1 was homogeneously added with the use of the KBr SOLUTION in an amount equivalent to $2\times10^{-5}$ mol/mol Ag with the remaining operation of the step (3) continued in the same manner as in the preparation of emulsion Em-a so that the total silver amount became the same as that of emulsion Em-a. The emulsion Em-m was cubic AgClBrI (AgI=7.0 mol %, AgCl=20 mol %) emulsion having an average grain diameter of 0.40 $\mu$m.

Table 1 lists the iodine content, grain size variation coefficient, chloride content, metal dopant amount and metal doped position with respect to each of emulsions Em-a to Em-m.

Each of emulsions Em-a to Em-m was subjected to optimum chemical sensitization with the use of sodium thiosulfate, sodium chloroaurate and potassium thiocyanate in the presence of spectral sensitizing dye S-4, doped with the following compounds and, together with a protective layer, co-extruded on a triacetylcellulose film support with an undercoat layer. Thus, samples 101 to 113 were obtained. The structural formula of the spectral sensitizing dye S-4 is shown in the following Example 2.

(1) Emulsion Layer

Emulsion: emulsions Em-a to Em-m (corresponding to samples 101 to 113).

Stabilizer: 4-hydroxy-6-methyl-1,3,3a,7-tetrazaindene.

(2) Protective Layer: Gelatin

Each of the samples was subjected to optimum exposure (1 sec) for sensitometry with light having passed through Fuji filter SC-50, subsequently to black and white development with developer D-19 of the composition specified below at 20° C. for 10 min and thereafter to stopping, fixing, washing with water, drying and density measurement according to the customary procedure.

Composition of Developer:

| | |
|---|---|
| metol | 2.2 g |
| $Na_2SO_3.7H_2O$ | 96 g |
| hydroquinone | 8.8 g |
| $Na_2CO_3$ | 56 g |
| KBr | 5.0 g |
| water to make | 1.0 L |
| pH = 10.1. | |

The sensitivity is defined as the inverse of the exposure producing the density equal to half of the sum of the fog and maximum density and is a relative value based on the value (100) of sample 101. The sensitivity and fog values are listed in the following Table 2.

TABLE 1

| Emulsion | Iodide Content (mol %) | Variation Coefficient of Grain Size (%) | Chloride Content (mol %) | Amount of Doped Metal ($\times 10^{-6}$ mol/mol Ag) | Position Doped with Metal | |
|---|---|---|---|---|---|---|
| Em-a | 4 | 10 | 0 | 0 | — | Comparison |
| Em-b | 15 | 25 | 0 | 0 | — | Comparison |
| Em-c | 4 | 11 | 0 | 2 (SET-2) | Grain Surface | Comparison |
| Em-d | 4 | 10 | 0 | 2 (SET-2) | Sub-Surface | Comparison |
| Em-e | 15 | 27 | 0 | 2 (SET-2) | Grain Surface | Comparison |
| Em-f | 4 | 11 | 2 | 2 (SET-2) | Grain Surface Separate from Chloride Layer | Invention |
| Em-g | 4 | 10 | 2 | 2 (SET-2) | Sub-Surface Interfacing with Chloride Layer | Invention |
| Em-h | 15 | 27 | 2 | 2 (SET-2) | Sub-Surface Interfacing with Chloride Layer | Invention |
| Em-i | 4 | 13 | 2 | 2 (SET-2) | Sub-Surface Interfacing with Chloride Layer | Invention |
| Em-j | 4 | 13 | 2 | 2 (SET-1) | Sub-Surface Interfacing with Chloride Layer | Invention |
| Em-k | 4 | 13 | 2 | 2 (SET-5) | Sub-Surface Interfacing with Chloride Layer | Invention |
| Em-l | 7 | 18 | 0 | 0 | — | Comparison |
| Em-m | 7 | 19 | 2 | 2 (SET-1) | Sub-Surface Interfacing with Chloride Layer | Invention |

TABLE 2

| Coated Sample | Emulsion | Sensitivity (Regarding the Sensitivity of Sample 101 as a Control) | Fogging | |
|---|---|---|---|---|
| 101 | Em-a | 100 | 0.04 | Comparison |
| 102 | Em-b | 95 | 0.04 | Comparison |
| 103 | Em-c | 105 | 0.06 | Comparison |
| 104 | Em-d | 102 | 0.04 | Comparison |
| 105 | Em-e | 101 | 0.07 | Comparison |
| 106 | Em-f | 117 | 0.06 | Invention |
| 107 | Em-g | 125 | 0.03 | Invention |
| 108 | Em-h | 110 | 0.05 | Comparison |
| 109 | Em-i | 138 | 0.03 | Invention |
| 110 | Em-j | 133 | 0.04 | Invention |
| 111 | Em-k | 134 | 0.03 | Invention |
| 112 | Em-l | 98 | 0.04 | Invention |
| 113 | Em-m | 123 | 0.03 | Invention |

It is apparent from Table 2 that the sensitivity enhancement is attained by introducing a silver chloride layer with a relatively low iodine content and carrying out a metal doping in its interface, and that the effect thereof is conspicuous especially in the use of tabular grains.

EXAMPLE 2

Preparation of Seed Emulsion 1600 mL of an aqueous solution containing 4.5 g of KBr and 7.9 g of gelatin having an average molecular weight of 15,000 was agitated with the temperature maintained at 40° C. An aqueous solution of $AgNO_3$ (8.9 g) and an aqueous solution of KBr (6.2 g) containing 6.3% by weight of KI were added by double jet over a period of 40 sec. 38 g of gelatin was added and the temperature was raised to 58° C. An aqueous solution of $AgNO_3$ (5.6 g) was added, 0.1 mol of ammonia was added and, 15 min later, the mixture was neutralized with acetic acid to thereby adjust the pH value to 5.0. An aqueous solution of $AgNO_3$ (219 g) and an aqueous KBr solution were added by double jet, while having the flow rates thereof accelerated, over a period of 40 min. During this period, the silver potential was maintained at −10 mV with respect to a saturated calomel electrode. Desalting was performed, 50 g of gelatin was added and the pH and pAg were adjusted to 5.8 and 8.8, respectively, at 40° C. Thus, a seed emulsion was prepared. This seed emulsion contained 1 mol of Ag and 80 g of gelatin per kg of emulsion and occupied by tabular grains having an average equivalent circular diameter of 0.62 μm, a variation coefficient of the diameter of 16%, an average thickness of 0.103 μm and an average aspect ratio of 6.0.

Preparation of Emulsion Em-1

1200 mL of an aqueous solution containing 134 g of the seed emulsions 1.9 g of KBr and 38 g of gelatin was agitated with the temperature maintained at 78° C. An aqueous solution of $AgNO_3$ (87.7 g) and an aqueous KBr solution were added by double jets while having the flow rates thereof accelerated, over a period of 46 min. During this period, the silver potential was maintained at −40 mV with respect to a saturated calomel electrode. Subsequently, an aqueous solution of $AgNO_3$ (42.6 g) and an aqueous KBr solution were added by double jet over a period of 17 min. During this period, the silver potential was maintained at +40 mV with respect to the saturated calomel electrode. Thereafter, 7.1 g of $AgNO_3$ and the equimolar amount of KI were simultaneously added quantitatively, and then an aqueous solution of $AgNO_3$ (66.4 g) and an aqueous solution of the equimolar amount of KBr were added by double jet over a period of 10 min while controlling the potential at 0 mV. Customary water washing was performed, gelatin was added and the pH and pAg were adjusted to 5.7 and 8.7, respectively, at 40° C. Thus prepared emulsion Em-1 was occupied by tabular grains (I=2.0 mol %) having an average equivalent circular diameter of 1.17 μm, a variation coefficient of the equivalent circular diameter of 26%, an average thickness of 0.23 μm, an average aspect ratio of 5.3 and an average equivalent spherical diameter of 0.77 μm. Grains having an aspect ratio of at least 5 accounted for at least 65% of the total projected area.

Preparation of Emulsion Em-2

Emulsion Em-2 was prepared in the same manner as emulsion Em-1, except that, at the time of the completion of addition of ⅓ of the $AgNO_3$ and KBr solutions (at the time of the completion of addition of 80% of the total silver amount to be added for grain formation) after the simultaneous additions of the $AgNO_3$ and KI solutions, the addition was discontinued and, thereafter, an NaCl solution was added in an amount of 1.56 g in terms of the weight of NaCl, followed by addition of 4.53 g of $AgNO_3$ (equivalent to 2 mol % of the total silver halide of final grains as AgCl), and again $AgNO_3$ and the equimolar amount of KBr were added so that the silver amount became the same as that of emulsion Em-1, prior to the same water washing and gelatin addition as in the preparation of emulsion Em-1.

Preparation of Emulsion Em-3

Emulsion Em-3 was prepared in the same manner as emulsion Em-2, except that SET-2 was added in an amount of $1\times10^{-5}$ mol/mol Ag (as defined in Example 1) after the addition of the NaCl solution and the addition of the $AgNO_3$ solution.

Preparation of Emulsion Em-4

Emulsion Em-4 was prepared in the same manner as emulsion Em-3, except that SET-2 was added in an amount of $2\times10^{-5}$ mol/mol Ag.

Preparation of Emulsion Em-5

Emulsion Em-5 was prepared in the same manner as emulsion Em-1, except that, at the time of the completion of addition of 98% of the total silver amount of final grains in the step of addition of the $AgNO_3$ and KBr solutions after the simultaneous additions of the $AgNO_3$ and KI solutions, the addition was discontinued and, thereafter, the NaCl solution was added in an amount of 156 g in terms of the weight of NaCl, followed by addition of 4.53 g of $AgNO_3$ (equivalent to 2 mol % as AgCl), prior to the water washing and gelatin addition.

Preparation of Emulsion Em-6

Emulsion Em-6 was prepared in the same manner as emulsion Em-5, except that SET-2 was added in an amount of $2\times10^{-5}$ mol/mol Ag just before the addition of the NaCl solution.

Preparation of Emulsion Em-7

Emulsion Em-7 was prepared in the same manner as emulsion Em-1, except that, at the time of the completion of addition of 90% of the total silver quantity of final grains in the step of addition of the $AgNO_3$ and KBr solutions after the simultaneous additions of the $AgNO_3$ and KI solutions, the addition was discontinued and, thereafter, the NaCl solution was added in an amount of 7.8 g in terms of the weight of NaCl, followed by addition of 22.7 g of $AgNO_3$ (equivalent to 10 mol % as AgCl), prior to the water washing and gelatin addition.

Preparation of Emulsion Em-8

Emulsion Em-8 was prepared in the same manner as emulsion Em-7, except that SET-2 was added in an amount of $2\times10^{-5}$ mol/mol Ag just before the addition of the NaCl solution.

Preparation of Emulsion Em-9

Emulsion Em-9 was prepared in the same manner as emulsion Em-7, except that SET-2 was added in an amount of $2\times10^{-5}$ mol/mol Ag at the time of the completion of addition of ½ of $AgNO_3$ after the addition of the NaCl solution.

Preparation of Emulsion Em-10

Emulsion Em-10 was prepared in the same manner as emulsion Em-6, except that spectral sensitizing dyes S-4, S-5 and S-9 were caused to be present in amounts needed for attaining optimum sensitivity before the addition of SET-2. The formulae of spectral sensitizing dyes S-4, S-5 and S-9 are shown later.

addition of 90% of the total silver amount of final grains in the step of addition of the $AgNO_3$ and KBr solutions after the simultaneous additions of the $AgNO_3$ and KI solutions.

Preparation of Emulsion Em-13

Emulsion Em-13 was prepared in the same manner as emulsion Em-1, except that SET-2 was added in an amount of $5\times10^{-5}$ mol/mol Ag at the time of the completion of addition of 90% of the $AgNO_3$ and KBr solutions after the simultaneous additions of the $AgNO_3$ and KI solutions.

Structural characteristics of emulsions Em-1 to Em-13 are summarized in Table 3. In any of the emulsion grains, dislocation lines were present on the periphery of the tabular grains.

The amount of silver chloride taken in the grains was determined from the concentration of chloride ions which were present in the supernatant of the emulsion before the water washing.

TABLE 3

| Emulsion No. | Place of AgCl Region and Its Form | Amount of Chloride Ion Added during Grain Formation (mol/mol Ag) | Amount of Silver Chloride that the Grain Actually Contains (mol/mol Ag) | Place Doped with a Metal | Addition Amount (mol/mol Ag) | |
|---|---|---|---|---|---|---|
| Em-1 | — | 0 | 0 | — | 0 | Comparison |
| Em-2 | Region from 80 to 82% of the Total Silver Amount | 2 | 1.3 | — | 0 | Comparison |
| Em-3 | Region from 80 to 82% of the Total Silver Amount | 2 | 1.3 | Interface between AgCl Layer and AgBr Layer | $1\times10^{-5}$ | Invention |
| Em-4 | Region from 80 to 82% of the Total Silver Amount | 2 | 1.3 | Interface between AgCl Layer and AgBr Layer | $2\times10^{-5}$ | Invention |
| Em-5 | Region from 98 to 100% of the Total Silver Amount | 2 | 2.0 | — | 0 | Comparison |
| Em-6 | Region from 98 to 100% of the Total Silver Amount | 2 | 2.0 | Interface between Layer and AgBr Layer | $2\times10^{-5}$ | Invention |
| Em-7 | Region from 90 to 100% of the Total Silver Amount | 10 | 10.0 | — | 0 | Comparison |
| Em-8 | Region from 90 to 100% of the Total Silver Amount | 10 | 10.0 | Interface between AgCl Layer and AgBr Layer | $2\times10^{-5}$ | Invention |
| Em-9 | Region from 90 to 100% of the Total Silver Amount | 10 | 10.0 | The Midst of AgCl Layer | $2\times10^{-5}$ | Invention |
| Em-10 | Region from 98 to 100% Edge Portion | 2 | 2.0 | Interface between AgCl Region and AgBr Layer | $2\times10^{-5}$ | Invention |
| Em-11 | Region from 98 to 100% Corner Portion | 2 | 2.0 | Interface between AgCl Region and AgBr Layer | $2\times10^{-5}$ | Invention |
| Em-12 | — | 0 | 0 | Position of 90% of the Total Silver Amount | $2\times10^{-5}$ | Comparison |
| Em-13 | — | 0 | 0 | Position of 90% of the Total Silver Amount | $5\times10^{-5}$ | Comparison |

Preparation of Emulsion Em-11

Emulsion Em-11 was prepared in the same manner as emulsion Em-10, except that SET-2 was added in an amount of $5\times10^{-4}$ mol/mol Ag just before the addition of the spectral sensitizing dyes.

Preparation of Emulsion Em-12

Emulsion Em-12 was prepared in the same manner as emulsion Em-1, except that SET-2 was added in an amount of $2\times10^{-5}$ mol/mol Ag at the time of the completion of The emulsions Em-1 to Em-13 were heated to 50 or 60° C. and doped with spectral sensitizing dyes S-4, S-5 and S-9 defined later except for emulsions Em-10, Em-11 and Em-12, and optimum chemical sensitization thereof was carried out with the use of potassium thiocyanate, chloroauric acid, sodium thiosulfate and N,N-dimethylselenourea.

Preparation of Coating Sample 201

A multilayered color lightsensitive material comprising a support of 127 μm-thick undercoated cellulose triacetate film and, superimposed thereon, layers of the following compositions was prepared and designated sample 201. The value indicates the amount of usage per square meter. The effect of each of the added compounds is not limited to the use described below.

| | | |
|---|---|---|
| 1st layer (antihalation layer) | | |
| black colloidal silver | | 0.10 g |
| gelatin | | 1.90 g |
| ultraviolet absorbent U-1 | | 0.10 g |
| ultraviolet absorbent U-3 | | 0.040 g |
| ultraviolet absorbent U-4 | | 0.10 g |
| high b.p. org. solvent oil-1 | | 0.10 g |
| microcrystalline solid dispersion of dye E-1 | | 0.10 g |
| 2nd layer (interlayer) | | |
| gelatin | | 0.40 g |
| compound Cpd-C | | 5.0 mg |
| compound Cpd-J | | 5.0 mg |
| compound Cpd-K | | 3.0 mg |
| high b.p. org. solvent oil-3 | | 0.10 g |
| dye D-4 | | 0.80 mg |
| 3rd layer (interlayer) | | |
| surface and interior fogged fine grain silver iodobromide emulsion (av. grain size 0.06 μm, var. coeff. 18% AgI cont. 1 mol %) | in terms of silver | 0.050 g |
| yellow colloidal silver | in terms of silver | 0.030 g |
| gelatin | | 0.40 g |
| 4th layer (low-speed red-sensitive emulsion layer) | | |
| emulsion A | in terms of silver | 0.30 g |
| emulsion B | in terms of silver | 0.20 g |
| gelatin | | 0.80 g |
| coupler C-1 | | 0.15 g |
| coupler C-2 | | 0.050 g |
| coupler C-3 | | 0.050 g |
| coupler C-9 | | 0.050 g |
| compound Cpd-C | | 5.0 mg |
| compound Cpd-J | | 5.0 mg |
| high b.p. org. solvent oil-2 | | 0.10 g |
| additive P-1 | | 0.10 g |
| 5th layer (medium-speed red-sensitive emulsion layer) | | |
| emulsion B | in terms of silver | 0.20 g |
| emulsion C | in terms of silver | 0.30 g |
| gelatin | | 0.80 g |
| coupler C-1 | | 0.20 g |
| coupler C-2 | | 0.050 g |
| coupler C-3 | | 0.20 g |
| high b.p. org. solvent oil-2 | | 0.10 g |
| additive P-1 | | 0.10 g |
| 6th layer (high-speed red-sensitive emulsion layer) | | |
| emulsion D | in terms of silver | 0.40 g |
| gelatin | | 1.10 g |
| coupler C-1 | | 0.30 g |
| coupler C-2 | | 0.10 g |
| coupler C-3 | | 0.70 g |
| additive P-1 | | 0.10 g |
| 7th layer (interlayer) | | |
| gelatin | | 0.60 g |
| additive M-1 | | 0.30 g |
| color mixing preventive Cpd-I | | 2.6 mg |
| dye D-5 | | 0.020 g |
| dye D-6 | | 0.010 g |
| compound Cpd-J | | 5.0 mg |
| high b.p. org. solvent oil-1 | | 0.020 g |
| 8th layer (interlayer) | | |
| surface and interior fogged fine grain silver iodobromide emulsion (av. grain size 0.06 μm, var. coeff. 18%, AgI cont. 0.3 mol %) | in terms of silver | 0.020 g |
| yellow colloidal silver | in terms of silver | 0.020 g |
| gelatin | | 1.00 g |
| additive p-1 | | 0.20 g |
| color mixing preventive Cpd-A | | 0.10 g |
| compound Cpd-C | | 0.10 g |
| 9th layer (low-speed green-sensitive emulsion layer) | | |
| emulsion E | in terms of silver | 0.10 g |
| emulsion F | in terms of silver | 0.20 g |
| emulsion G | in terms of silver | 0.20 g |
| gelatin | | 0.50 g |
| coupler C-4 | | 0.10 g |
| coupler C-7 | | 0.050 g |
| coupler C-8 | | 0.10 g |
| compound Cpd-B | | 0.030 g |
| compound Cpd-D | | 0.020 g |
| compound Cpd-F | | 0.040 g |
| compound Cpd-E | | 0.020 g |
| compound Cpd-J | | 10 mg |
| compound Cpd-L | | 0.020 g |
| high b.p. org. solvent oil-1 | | 0.10 g |
| high b.p. org. solvent oil-2 | | 0.10 g |
| 10th layer (medium-speed green-sensitive emulsion layer) | | |
| emulsion G | in terms of silver | 0.50 g |
| emulsion H | in terms of silver | 0.10 g |
| gelatin | | 0.60 g |
| coupler C-4 | | 0.070 g |
| coupler C-7 | | 0.050 g |
| coupler C-8 | | 0.050 g |
| compound Cpd-B | | 0.030 g |
| compound Cpd-D | | 0.020 g |
| compound Cpd-E | | 0.020 g |
| compound Cpd-F | | 0.050 g |
| compound Cpd-L | | 0.050 g |
| high b.p. org. solvent oil-2 | | 0.010 g |
| high b.p. org. solvent oil-4 | | 0.050 g |
| 11th layer (high-speed green-sensitive emulsion layer) | | |
| emulsion I | in terms of silver | 0.50 g |
| gelatin | | 1.00 g |
| coupler C-4 | | 0.20 g |
| coupler C-7 | | 0.10 g |
| coupler C-8 | | 0.050 g |
| compound Cpd-B | | 0.080 g |
| compound Cpd-E | | 0.020 g |
| compound Cpd-F | | 0.040 g |
| compound Cpd-K | | 5.0 mg |
| compound Cpd-L | | 0.020 g |
| high b.p. org. solvent oil-1 | | 0.020 g |
| high b.p. org. solvent oil-2 | | 0.020 g |
| 12th layer (interlayer) | | |
| gelatin | | 0.60 g |
| compound Cpd-L | | 0.050 g |
| high b.p. org. solvent oil-1 | | 0.050 g |
| 13th layer (yellow filter layer) | | |
| yellow colloidal silver | in terms of silver | 0.020 g |
| gelatin | | 1.10 g |
| color mixing preventive Cpd-A | | 0.010 g |
| compound Cpd-L | | 0.010 g |
| high b.p. org. solvent oil-1 | | 0.010 g |
| microcrystalline solid dispersion of dye E-2 | | 0.030 g |
| microcrystalline solid dispersion of dye E-3 | | 0.020 g |
| 14th layer (interlayer) | | |
| gelatin | | 0.60 g |
| 15th layer (low-speed blue-sensitive emulsion layer) | | |
| emulsion J | in terms of silver | 0.30 g |
| emulsion K | in terms of silver | 0.30 g |
| gelatin | | 0.80 g |
| coupler C-5 | | 0.20 g |

-continued

| | | |
|---|---|---|
| coupler C-6 | | 0.10 g |
| coupler C-10 | | 0.40 g |
| 16th layer (medium-speed blue-sensitive emulsion layer) | | |
| emulsion L | in terms of silver | 0.30 g |
| emulsion M | in terms of silver | 0.30 g |
| gelatin | in terms of silver | 0.90 g |
| coupler C-5 | | 0.10 g |
| coupler C-6 | | 0.10 g |
| coupler C-10 | | 0.60 g |
| 17th layer (high-speed blue-sensitive emulsion layer) | | |
| emulsion N | in terms of silver | 0.20 g |
| emulsion O | in terms of silver | 0.20 g |
| gelatin | | 1.20 g |
| coupler C-5 | | 0.10 g |
| coupler C-6 | | 0.10 g |
| coupler C-10 | | 0.60 g |
| high b.p. org. solvent oil-2 | | 0.10 g |
| 18th layer (1st protective layer) | | |
| gelatin | | 0.70 g |
| ultraviolet absorbent U-1 | | 0.20 g |
| ultraviolet absorbent U-2 | | 0.050 g |
| ultraviolet absorbent U-5 | | 0.30 g |
| compound Cpd-G | | 0.050 g |
| formaldehyde scavenger | | 0.40 g |
| compound Cpd-H | | |
| dye D-1 | | 0.15 g |
| dye D-2 | | 0.050 g |
| dye D-3 | | 0.10 g |
| high b.p. org. solvent oil-3 | | 0.10 g |
| 19th layer (2nd protective layer) | | |
| colloidal silver | in terms of silver | 0.10 mg |
| fine grain silver iodobromide emulsion (av. grain size 0.06 μm, AgI cont. 1 mol %) | in terms of silver | 0.10 g |
| gelatin | | 0.40 g |
| 20th layer (3rd protective layer) | | |
| gelatin | | 0.40 g |
| polymethyl methacrylate (av. grain size 1.5 μm) | | 0.10 g |

-continued

| | |
|---|---|
| methyl methacrylate/acrylic acid 4:6 copolymer (av. grain size 1.5 μm) | 0.10 g |
| silicone oil SO-1 | 0.030 g |
| surfactant W-1 | 3.0 mg |
| surfactant W-2 | 0.030 g |

Into all the above emulsion layers, additives F-1 to F-8 in addition to the above components, and, further, gelatin hardener H-1 and surfactants for emulsification and coating W-3, W-4, W-5 and W-6 were added to each layer in addition to the above components.

Moreover, phenol, 1, 2-benzisothiazolin-3-one, 2-phenoxyethanol, phenethyl alcohol and butyl p-benzoate were added as antiseptic and mildewproofing agents.

Preparation of Dispersion of Organic Solid Dispersed Dye

Dye E-1 was dispersed by the following method. That is, water and 200 g of Pluronic F88 (trade name for ethylene oxide/propylene oxide block copolymer) produced by BASF were added to 1430 g of dye wet cake containing 30% of methanol and agitated, thereby obtaining a slurry having a dye content of 6%. 1700 mL of zirconia beads having an average grain size of 0.5 mm were charged into Ultravis-comill (UVM-2) manufactured by Aimex Co., Ltd. and the slurry was milled at a peripheral speed of about 10 m/sec and a delivery of 0.5 L/min for 8 hr. The beads were removed by filtration and the slurry was diluted with water into a dye content of 3%. The dilution was heated at 90° C. for 10 hr for stabilization. The obtained fine dye grains had an average grain size of 0.60 μm and a grain size distribution breadth (standard deviation of grain sizes×100/average grain size) of 18%.

Solid dispersions of dyes E-2 and E-3 were obtained in the same manner, respectively The average grain sizes thereof were 0.54 μm and 0.56 μm, respectively.

The formulae of compounds employed in the Examples are shown below.

C-1

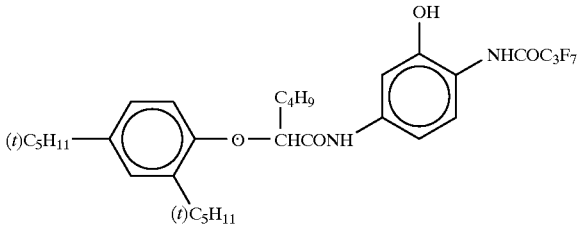

C-2

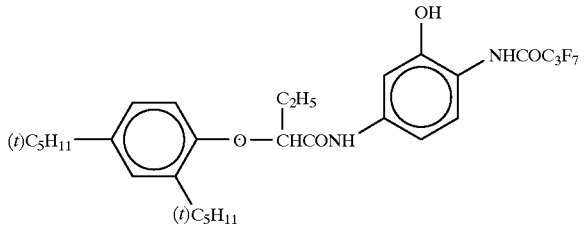

-continued
C-3
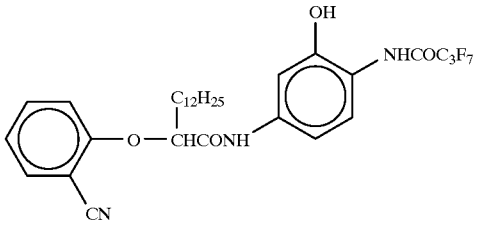
C-4
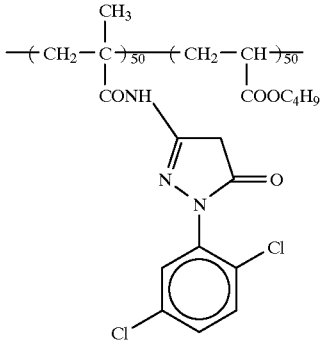
The numbers signify wt. %
Average Molecular Weight:
about 25,000
C-5
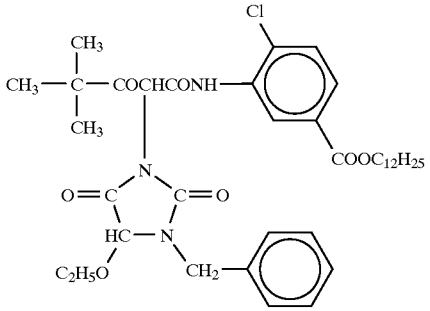
C-6
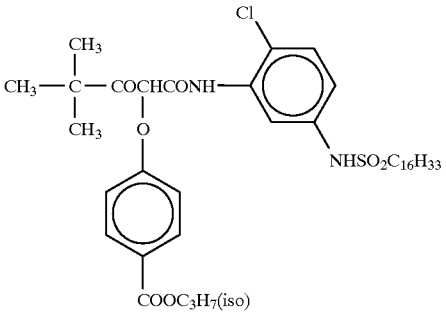

-continued
C-7
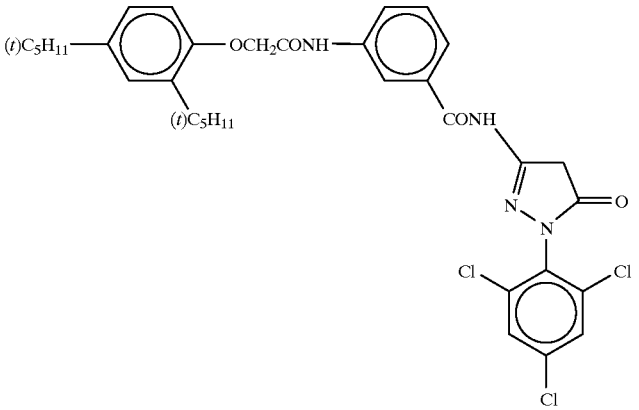
C-8
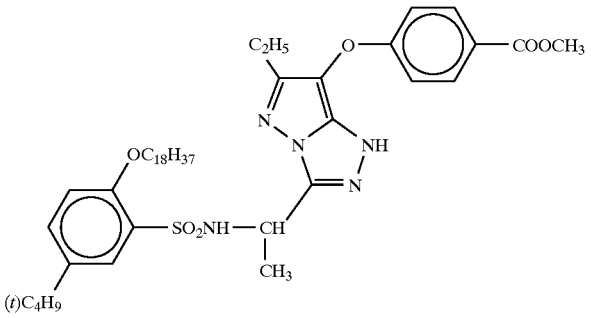
C-9
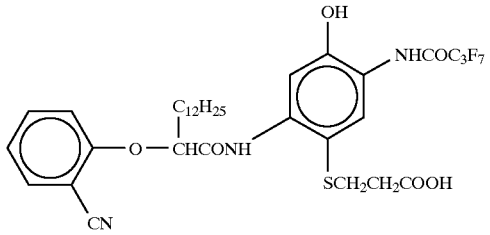
C-10
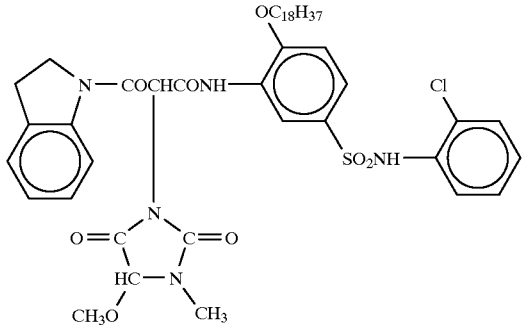
Oil-1
Dibutyl phthalate
Oil-2
Tricresyl Phosphate
Oil-3
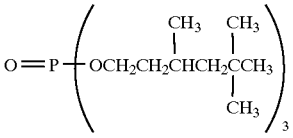

-continued
Oil-4
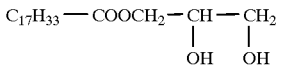
Cpd-A
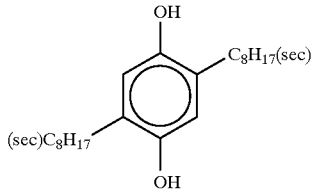
Cpd-B
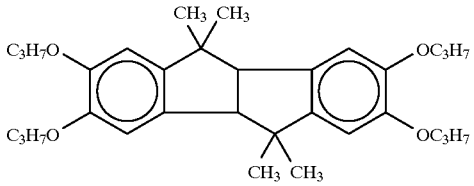
Cpd-C
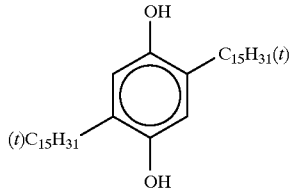
Cpd-D
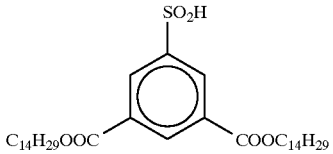
Cpd-E
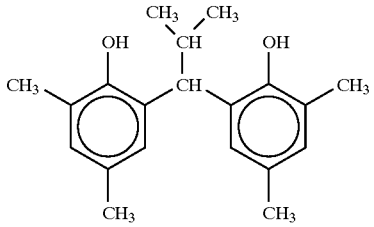
Cpd-F
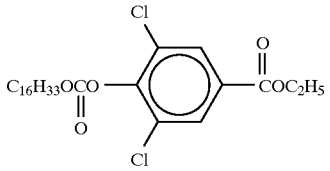
Cpd-G
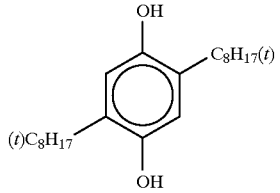

-continued
Cpd-H
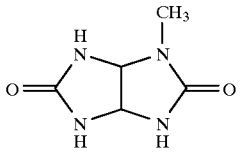
Cpd-I
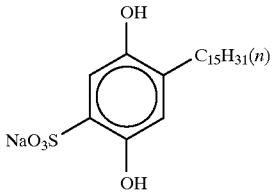
Cpd-J
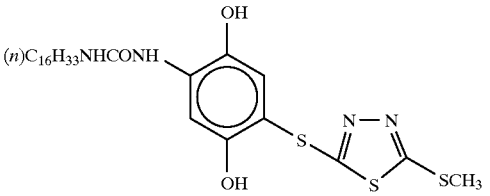
Cpd-K
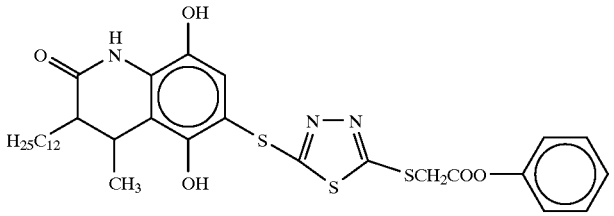
Cpd-L
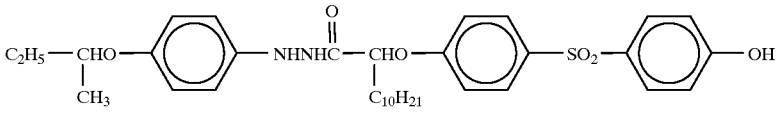
U-1
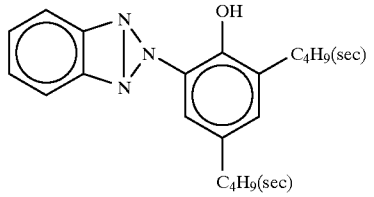
U-2
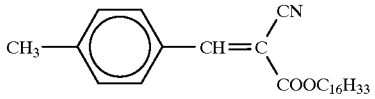
U-3
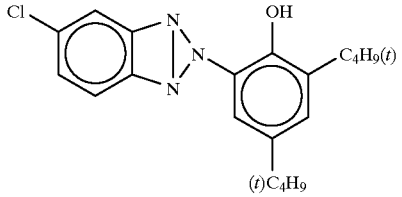

-continued
U-4
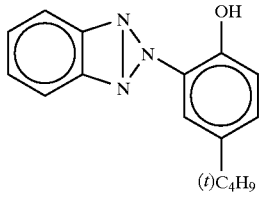
U-5
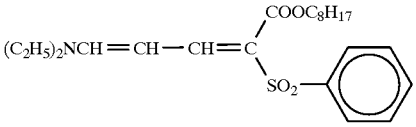
S-1
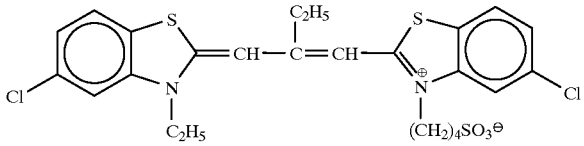
S-2
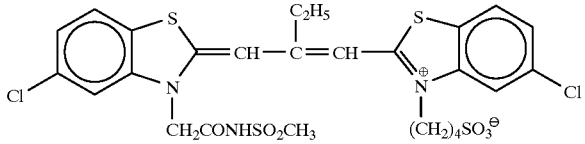
S-3
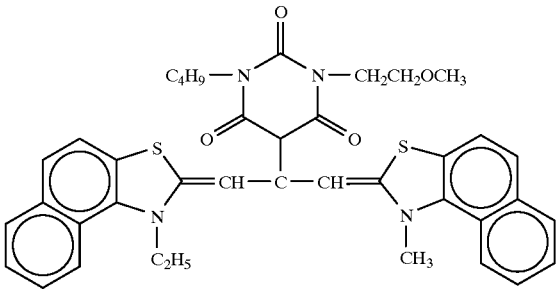
S-4
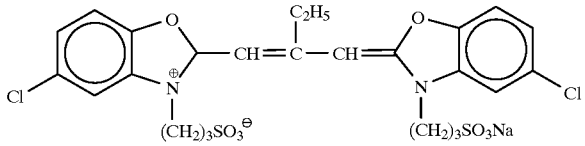
S-5
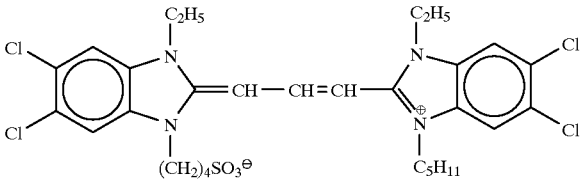

-continued
S-6
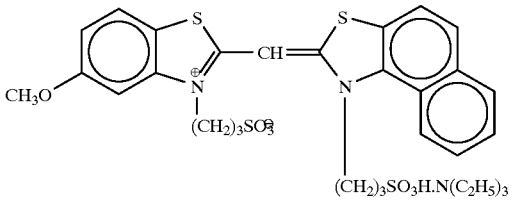
S-7
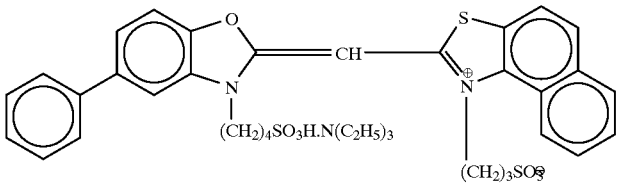
S-8
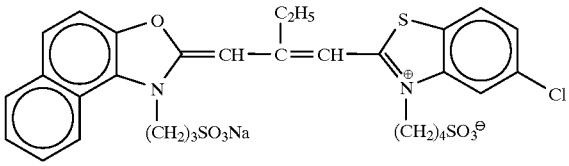
S-9
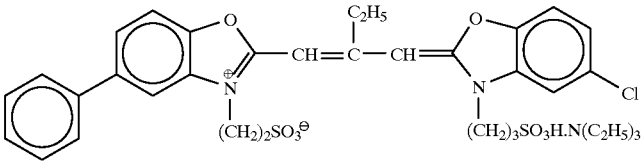
D-1
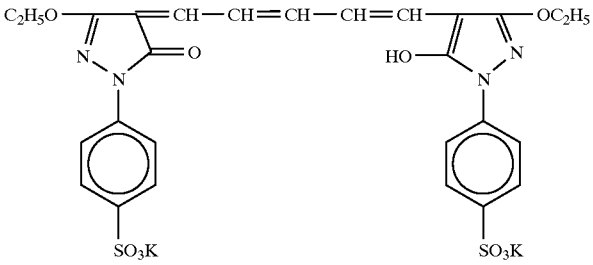
D-2
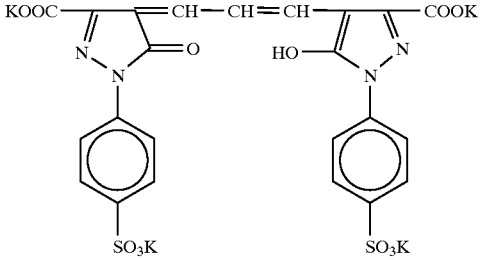

-continued
D-3
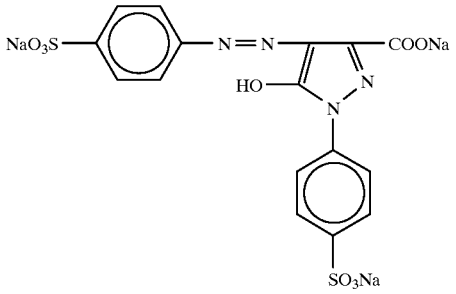
D-4
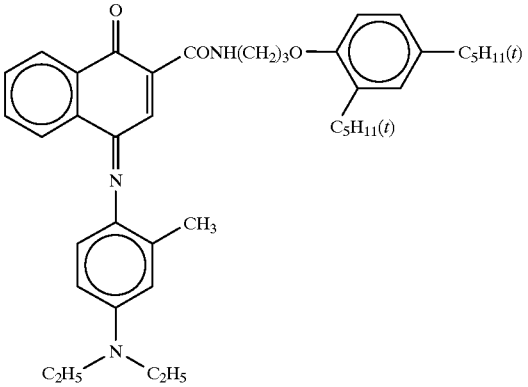
D-5
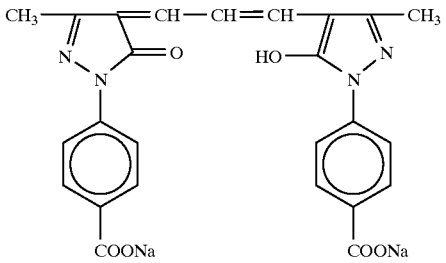
D-6
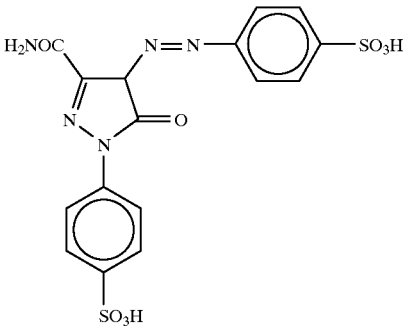
E-1
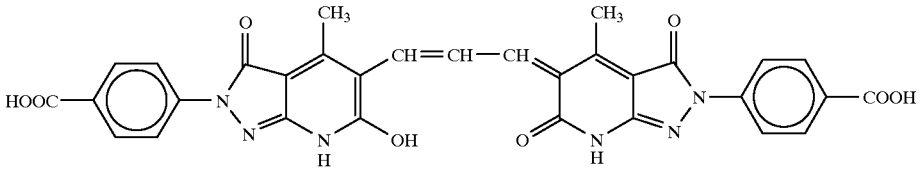

-continued
E-2
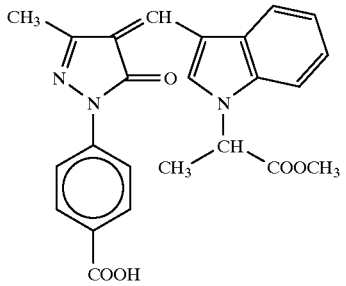
E-3
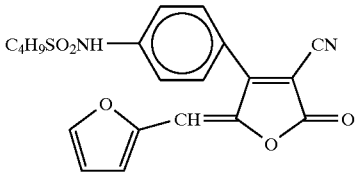
H-1
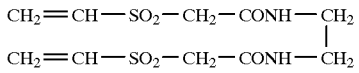
W-1
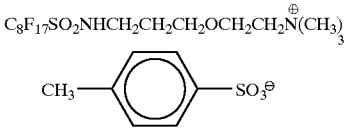
W-2
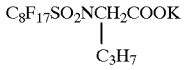
W-3
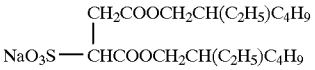
W-4
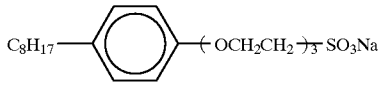
W-5
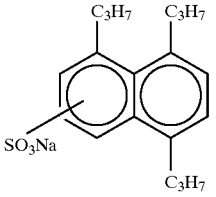
W-6
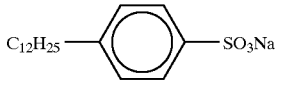
P-1
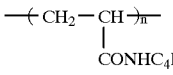
n = 100 ~ 1000

-continued
M-1
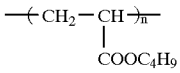
n = 100 ~ 100
F-1
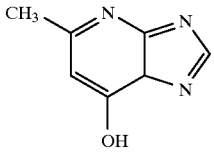
SO-1
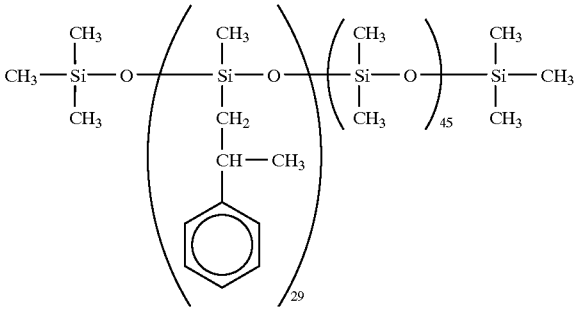
F-2
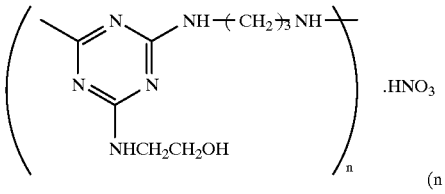
(n = 3-4)
F-3
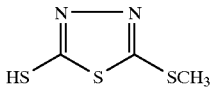
F-4
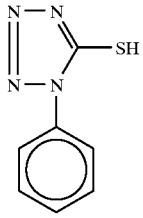
F-5
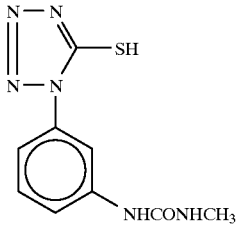
F-6
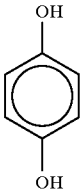

-continued

F-7

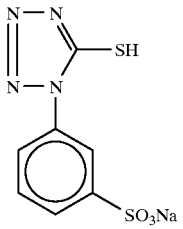

F-8

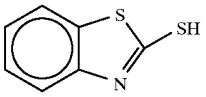

The silver iodobromide emulsion used in sample 201 is as follows.

TABLE 4

Silver Iodobromide Emulsions Used in Sample 201 Are as Follows:

| Emulsion | Characteristic of Grains | Average Equivalent Sphere Diameter of Grains (μm) | Variation Coefficient (%) | AgI Content (%) |
|---|---|---|---|---|
| A | Monodisperse Tetradecahedral Grains | 0.28 | 16 | 4.0 |
| B | Monodisperse Cubic Internal Latent Image-type Grains | 0.30 | 10 | 4.0 |
| C | Monodisperse Cubic Grains | 0.38 | 10 | 5.0 |
| D | Monodisperse Tabular Grains Having an Aspect Ratio of 3.0 | 0.68 | 8 | 2.0 |
| E | Monodisperse Cubic Grains | 0.20 | 17 | 4.0 |
| F | Monodisperse Tetradecahedral Grains | 0.25 | 16 | 4.0 |
| G | Monodisperse Cubic Internal Latent Image-type Grains | 0.40 | 11 | 4.0 |
| H | Monodisperse Cubic Grains | 0.50 | 9 | 3.5 |
| I | Monodisperse Tabular Grains Having an Aspect Ratio of 5.0 | 0.80 | 10 | 2.0 |
| J | Monodisperse Cubic Grains | 0.30 | 18 | 4.0 |
| K | Monodisperse Tetradecahedral Grains | 0.45 | 17 | 4.0 |
| L | Monodisperse Tabular Grains Having an Aspect Ratio of 5.0 | 0.55 | 10 | 2.0 |
| M | Monodisperse Tabular Grains Having an Aspect Ratio of 8.0 | 0.70 | 13 | 2.0 |
| N | Monodisperse Tabular Grains Having an Aspect Ratio of 6.0 | 1.00 | 10 | 1.5 |
| O | Monodisperse Tabular Grains Having an Aspect Ratio of 9.0 | 1.20 | 15 | 1.5 |

TABLE 5

Spectral Sensitization of Emulsion A to I

| Emulsion | Spectral Sensitizing Dye Added | Amount Added per mol of Silver Halide (g) |
|---|---|---|
| A | S-2 | 0.025 |
| | S-3 | 0.25 |
| | S-8 | 0.010 |
| B | S-1 | 0.010 |
| | S-3 | 0.25 |
| | S-8 | 0.010 |
| C | S-1 | 0.010 |
| | S-2 | 0.010 |
| | S-3 | 0.25 |
| | S-8 | 0.010 |
| D | S-2 | 0.010 |
| | S-3 | 0.10 |
| | S-8 | 0.010 |
| E | S-4 | 0.50 |
| | S-5 | 0.10 |
| F | S-4 | 0.30 |
| | S-5 | 0.10 |
| G | S-4 | 0.25 |
| | S-5 | 0.08 |
| | S-9 | 0.05 |
| H | S-4 | 0.20 |
| | S-5 | 0.060 |
| | S-9 | 0.050 |
| I | S-4 | 0.30 |
| | S-5 | 0.070 |
| | S-9 | 0.10 |

TABLE 6

Spectral Sensitization of Emulsion J to O

| Emulsion | Spectral Sensitizing Dye Added | Amount Added per mol of Silver Halide (g) |
|---|---|---|
| J | S-6 | 0.050 |
| | S-7 | 0.20 |
| K | S-6 | 0.05 |
| | S-7 | 0.20 |
| L | S-6 | 0.060 |
| | S-7 | 0.22 |
| M | S-6 | 0.050 |
| | S-7 | 0.17 |
| N | S-6 | 0.040 |
| | S-7 | 0.15 |

TABLE 6-continued

Spectral Sensitization of Emulsion J to O

| Emulsion | Spectral Sensitizing Dye Added | Amount Added per mol of Silver Halide (g) |
|---|---|---|
| O | S-6 | 0.060 |
| | S-7 | 0.22 |

Samples 202 to 214 were produced in the same manner as Sample 201 except that the high-speed green-sensitive emulsion I used in the preparation of the latter was replaced by emulsions Em-1 to Em-13, respectively.

Evaluation of Samples (a) Evaluation of Sensitivity and Fog

The sensitivity of each of the prepared samples 201 to 214 was determined by conducting a wedge exposure with the use of a 2000 lux white light source of 4800 K color temperature in 1/50 sec, conducting the following development, measuring the exposure imparting a magenta density of 0.5 and 2.0, respectively, and calculating each relative value of the inverse of each relative exposure amount. The basis was provided by sample 202, to which a value of 100 was assigned, as shown in Table 7. In case the sensitivity at the density of 0.5 is higher than that at a density of 2.5, gradation is hard. The fog is exhibited by a lowering of maximum magenta density. The greater the degree of the lowering, the higher the level of the fog.

TABLE 7

| Sample No. | Emulsion No. | Relative Sensitivity (Magenta Density of 0.5) | Relative Sensitivity (Magenta Density of 2.5) | Maximum Density | |
|---|---|---|---|---|---|
| 201 | I | 98 | 97 | 99 | Comparison |
| 202 | Em-1 | 100 | 100 | 100 | Comparison (control) |
| 203 | Em-2 | 98 | 102 | 98 | Comparison |
| 204 | Em-3 | 110 | 103 | 98 | Invention |
| 205 | Em-4 | 113 | 105 | 97 | Invention |
| 206 | Em-5 | 97 | 101 | 95 | Comparison |
| 207 | Em-6 | 115 | 105 | 97 | Invention |
| 208 | Em-7 | 96 | 100 | 94 | Comparison |
| 209 | Em-8 | 110 | 103 | 97 | Invention |
| 210 | Em-9 | 103 | 100 | 97 | Invention |
| 211 | Em-10 | 117 | 106 | 98 | Invention |
| 212 | Em-11 | 120 | 106 | 98 | Invention |
| 213 | Em-12 | 108 | 101 | 99 | Comparison |
| 214 | Em-13 | 110 | 102 | 99 | Comparison |

Processing step and processing solution of standard developing treatment

| Step | Time (min) | Temp. (°C.) | Tank vol. (L) | Replenishment rate (mL/m) |
|---|---|---|---|---|
| 1st. development | 6 | 38 | 12 | 2200 |
| water washing | 2 | 38 | 4 | 7500 |
| reversal | 2 | 38 | 4 | 1100 |
| color development | 6 | 38 | 12 | 2200 |
| prebleaching | 2 | 38 | 4 | 1100 |
| bleaching | 6 | 38 | 12 | 220 |
| fixing | 4 | 38 | 8 | 1100 |
| water washing | 4 | 38 | 8 | 7500 |
| final rinse | 1 | 25 | 2 | 1100 |

The composition of each processing solution was as follows.

| (1st development solution) | Tank soln. | Replenisher |
|---|---|---|
| pentasodium nitrilo-N,N,N-trimethylenephosphonate | 1.5 g | 1.5 g |
| pentasodium diethylenetriaminepentacetate | 2.0 g | 2.0 g |
| sodium sulfite | 30 g | 30 g |
| potassium hydroquinone-monosulfonate | 20 g | 20 g |
| potassium carbonate | 15 g | 20 g |
| sodium bicarbonate | 12 g | 15 g |
| 1-phenyl-4-methyl-4-hydroxymethyl-3-pyrazolidone | 1.5 g | 2.0 g |
| potassium bromide | 2.5 g | 1.4 g |
| potassium thiocyanate | 1.2 g | 1.2 g |
| potassium iodide | 2.0 mg | — |
| diethylene glycol | 13 g | 15 g |
| water to make | 1000 mL | 1000 mL |
| pH | 9.60 | 9.60 |

This pH was adjusted by the use of sulfuric acid or potassium hydroxide.

| (reversal solution) | Tank soln. | Replenisher |
|---|---|---|
| pentasodium nitrilo-N,N,N-trimethylenephosphonate | 3.0 g | same as left |
| stannous chloride dihydrate | 1.0 g | same as left |
| p-aminophenol | 0.1 g | same as left |
| sodium hydroxide | 8 g | same as left |
| glacial acetic acid | 15 mL | same as left |
| water to make | 1000 mL | same as left |
| pH | 6.00 | same as left |

This pH was adjusted by the use of acetic acid or sodium hydroxide.

| (Color developer) | Tank soln. | Replenisher |
|---|---|---|
| pentasodium nitrilo-N,N,N-trimethylenephosphonate | 2.0 g | 2.0 g |
| sodium sulfite | 7.0 g | 7.0 g |
| trisodium phosphate dodecahydrate | 36 g | 36 g |
| potassium bromide | 1.0 g | — |
| potassium iodide | 90 mg | — |
| sodium hydroxide | 3.0 g | 3.0 g |
| citrazinic acid | 1.5 g | 1.5 g |
| N-ethyl-N-(á-methanesulfonamidoethyl)-3-methyl-4-aminoaniline 3/2 sulfate monohydrate | 11 g | 11 g |
| 3,6-dithiaoctane-1,8-diol | 1.0 g | 1.0 g |
| water to make | 1000 mL | 1000 mL |
| pH | 11.80 | 12.00 |

This pH was adjusted by the use of sulfuric acid or potassium hydroxide.

| (Prebleaching) | Tank soln. | Replenisher |
|---|---|---|
| disodium ethylenediaminetetraacetate dihydrate | 8.0 g | 8.0 g |
| sodium sulfite | 6.0 g | 8.0 g |
| 1-thioglycerol | 0.4 g | 0.4 g |
| formaldehyde/sodium bisulfite adduct | 30 g | 35 g |

-continued

| (Prebleaching) | Tank soln. | Replenisher |
|---|---|---|
| water to make | 1000 mL | 1000 mL |
| pH | 6.30 | 6.10 |

This pH was adjusted by the use of acetic acid or sodium hydroxide.

| (Bleaching soln.) | Tank soln. | Replenisher |
|---|---|---|
| disodium ethylenediamine-tetraacetate dihydrate | 2.0 g | 4.0 g |
| Fe(III) ammonium ethylene-diaminetetraacetate dihydrate | 120 g | 240 g |
| potassium bromide | 100 g | 200 g |
| ammonium nitrate | 10 g | 20 g |
| water to make | 1000 mL | 1000 mL |
| pH | 5.70 | 5.50 |

This pH was adjusted by the use of nitric acid or sodium hydroxide.

| (Fixing solution) | Tank soln. | Replenisher |
|---|---|---|
| ammonium thiosulfate | 80 g | same as left |
| sodium sulfite | 5.0 g | same as left |
| sodium bisulfite | 5.0 g | same as left |
| water to make | 1000 mL | same as left |
| pH | 6.60 | same as left |

This pH was adjusted by the use of acetic acid or aqueous ammonia.

| (Final rinse) | Tank soln. | Replenisher |
|---|---|---|
| 1,2-benzoisothiazolin-3-one | 0.02 g | 0.03 g |
| polyoxyethylene p-monononyl-phenyl ether (av. degree of polymerization. 10) | 0.3 g | 0.3 g |
| polymaleic acid (av. mol. wt. 2,000) | 0.1 g | 0.15 g |
| water to make | 1000 mL | 1000 mL |
| pH | 7.0 | 7.0 |

(b) RMS Granularity

RMS granularity was measured at magenta densities of 0.5 and 2.5. Table 8 lists results expressed by relative values to the RMS granularity of sample 202 to which 100 was assigned. The smaller the value, the more desirable the granularity It is apparent that the samples of the present invention exhibit improved granularity at both the regions of densities of 0.5 and 2.5.

TABLE 8

| Sample No. | Granularity (Magenta Density of 0.5) | Granularity (Magenta Density of 2.5) | Metal Doping Ratio (%) | |
|---|---|---|---|---|
| 201 | 100 | 101 | — | Comparison |
| 202 | 100 | 100 | — | Comparison (control) |
| 203 | 96 | 97 | — | Comparison |
| 204 | 97 | 97 | 91 | Invention |
| 205 | 96 | 98 | 85 | Invention |
| 206 | 85 | 88 | — | Comparison |
| 207 | 84 | 88 | 87 | Invention |
| 208 | 90 | 91 | — | Comparison |
| 209 | 92 | 92 | 88 | Invention |
| 210 | 91 | 92 | 81 | Invention |
| 211 | 84 | 87 | 87 | Invention |
| 212 | 85 | 87 | 83 | Invention |
| 213 | 100 | 101 | 70 | Comparison |
| 214 | 101 | 102 | 69 | Comparison |

It is apparent from Table 8 that, although the emulsion having the silver chloride layer introduced therein by itself cannot exhibit satisfactory performance, a highly sensitive emulsion of hard gradation can be obtained by causing metal complex (SET-2) to be present in the vicinity of an interface of the silver chloride layer and the silver bromide layer. Optimum results were obtained by forming a relatively small amount of silver chloride region locally at the surface. Although the sample doped with a metal complex in the absence of a silver chloride layer also tended to be highly sensitive and have hard gradation, the amount of the dopant was inevitably large and the graininess was inferior to that of the emulsion in which the silver chloride layer was present as apparent from Table 8. The amount of metal incorporated in the sample relative to the amount of dopant metal added during the grain preparation was analyzed by the atomic absorption method, and unexpected result was obtained that the more desirable the result, the larger the relative amount.

Although the most desirable results were obtained by sample no. 212 (Em-11), it has been found that the same performance can also be exhibited by doping emulsion Em-11 with a metal in an amount of $1\times10^{-4}$ mol/mol Ag.

EXAMPLE 3

With respect to the red-sensitive layer of sample 201 of Example 2 as well, a sample was prepared and evaluated in the same manner as in Example 2. The effect of the present invention on the red-sensitive layer was checked and the same effect as in Example 2 was confirmed.

EXAMPLE 4

With respect to the blue-sensitive layer of sample 201 of Example 2 as well, a sample was prepared and evaluated in the same manner as in Example 2. The effect of the present invention on the blue-sensitive layer was checked and the same effect as in Example 2 was confirmed.

The silver halide color lightsensitive material of the first embodiment of the present invention is excellent in sensitivity gradation and graininess as compared with those of the prior art materials.

EXAMPLE 5

(1) Preparation of Emulsion Em-A (i) 1.6 L of an aqueous solution containing 0.6 g of KBr and 0.8 g of gelatin with an average molecular weight of 15,000 had its temperature maintained at 35° C. and had its pBr maintained at 2.8.

(ii) 60 mL of an aqueous solution of silver nitrate (containing 20.0 g of silver nitrate per 100 mL) and 60 mL of an aqueous solution of potassium bromide (containing 14.0 g of potassium bromide per 100 mL) containing low molecular weight gelatin in a concentration of 0.02 g/mL were simultaneously added by a double jet method to the aqueous solution of item (i) above in a common flow rate of 60 mL/min under agitation.

(iii) Immediately thereafter, 5.3 g of potassium bromide was added and heated up to 40° C. to thereby effect a ripening.

(iv) 85 min after the addition of silver nitrate, again, an aqueous solution of silver nitrate (containing 32.0 g of silver nitrate per 100 mL) and an aqueous halogen solution (containing 22.4 g of potassium bromide and 1.25 g of potassium iodide per 100 mL) were added in a accelerating flow rate to the aqueous solution for 16 min while maintaining the silver potential against saturated calomel electrode at −15 mV. By this stage, 50% of the total amount of silver nitrate was consumed.

(v) Consecutively, an aqueous solution of silver nitrate (containing 14.2 g of silver nitrate per 100 mL) and an aqueous solution of potassium bromide (containing 22.4 g of potassium bromide per 100 mL) were added by a double jet method to the aqueous solution over 4 min. By this stage, 54% of the total amount of silver nitrate was consumed.

(vi) Thereafter, again, an aqueous solution of silver nitrate (containing 32.0 g of silver nitrate per 100 mL) and an aqueous solution of potassium bromide (containing 22.4 g of potassium bromide per 100 mL) were added by a double jet method to the aqueous solution over 43 min while maintaining the pAg at 9.7. By this stage, 212 g of silver nitrate was consumed.

(vii) Consecutively, an aqueous solution of silver nitrate (containing 32.0 g of silver nitrate per 100 mL) and an aqueous halogen solution (containing 22.4 g of potassium bromide and 1.99 g of potassium iodide per 100 mL) were added by a double jet method to the aqueous solution for 5 min while maintaining the pAg at 7.0. By this stage, 232 g of silver nitrate was consumed.

(viii) After the completion of the above additions, an aqueous solution containing 1.4 g of below described dye ExS-3 and an aqueous solution containing 0.04 g of ExS-2 were added to the above aqueous solution and allowed to stand still for 20 min.

(ix) The resultant emulsion was washed with water at 35° C. according to the known flocculation method, and gelatin was added thereto and heated up to 40° C.

(x) 10 min later the temperature was raised to 76° C., and sodium thiosulfate, potassium thiocyanate and chloroauric acid were added thereto in amounts of $3.5\times10^{-5}$, $3.5\times10^{-3}$ and $1.2\times10^{-5}$ mol/mol of silver, respectively and ripened so that the sensitivity upon 1/100 sec exposure was maximized. Thereafter, sodium 3-(5-mercaptotetrazole) benzenesulfonate was added in an amount of $4.0\times10^{-4}$ mol/mol of silver.

The thus obtained emulsion was designated emulsion Em-A.

The emulsion Em-A was occupied by tabular AgBrI grains (I content: 4 mol %) having a coefficient of variation of projected area equivalent circular diameter of 23%, an equivalent circular diameter of 0.31 μm and an average thickness of 0.07 μm.

ExS-2

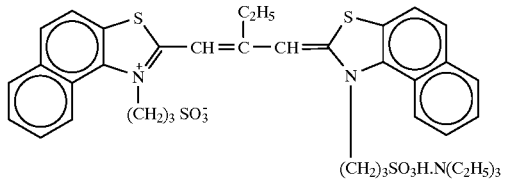

ExS-3

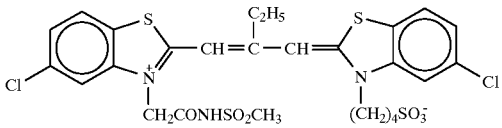

Preparation of Emulsions Em-B to Em-D

In step (v) of the preparation of emulsion Em-A, an aqueous solution of a mixture of sodium bromide and sodium chloride was used in place of the aqueous solution of potassium bromide, thereby forming a silver chloride-containing layer. The silver chloride content of the silver chloride-containing layer is listed in Table 1 given later. The grain configuration was the same as that of emulsion Em-A.

Preparation of Emulsion Em-E

An aqueous solution of silver nitrate and an aqueous solution of a mixture of 6.3 g of sodium chlorides 10 g of potassium bromide and 1.66 g of potassium iodide were added consecutively to the step (viii) of the preparation of emulsion Em-A. The pAg was maintained at 5.9. 246 g of silver nitrate was consumed by this stage. This stage was designated step (viii)-2. The step (ix) and subsequent steps of the preparation of emulsion Em-A were carried out, thereby obtaining emulsion Em-E. Silver halide protrusions were observed at vertex parts of the tabular grains.

Preparation of Emulsions Em-F to Em-H

In the step (v) of the preparation of emulsion Em-E, an aqueous solution of a mixture of sodium bromide and sodium chloride was used in place of the aqueous solution of potassium bromide, thereby forming a silver chloride-containing layer. The silver chloride content of the silver chloride-containing layer is listed in Table 9 given later. The grain configuration was the same as that of emulsion Em-E.

(2) Preparation of Coated Samples

Dodecylbenzenesulfonate as a coating auxiliary, a p-vinylbenzenesulfonate as a thickening agent, a vinyl sulfone compound as a hardening agent and a polyethylene oxide compound as a photographic characteristics improver were added to each of the emulsions obtained in item (1) above, thereby obtaining emulsion coating solutions. Subsequently, each of the obtained emulsion coating solutions was uniformly applied onto a separately undercoated polyester base and a surface protective layer composed mainly of an aqueous gelatin solution was applied thereonto. Thus, there were prepared coating samples having emulsions Em-A to Em-H applied thereto. The amount of applied silver of each sample, the amount of applied gelatin of each protective layer and the amount of applied gelatin of each emulsion layer were 4.0, 1.3 and 2.7 g/m$^2$, respectively.

The following test was conducted for evaluating the characteristics of each coating sample thus obtained.

A piece of each coating sample was subjected to a wedge exposure conducted at an exposure value of 20 CMS and at an exposure duration of 1/100 sec, developed with a processing solution of the below specified composition at 20° C. for 4 min and sequentially subjected to fixings water washing, drying and sensitometry. The sensitivity was determined by measuring an exposure value imparting a density of fog value +0.1 and calculating the inverse number of the exposure value, and the fog value was determined.

| (Processing solution) | | |
|---|---|---|
| 1-phenyl-3-pyrazolidone | 0.5 | g |
| hydroquinone | 10 | g |
| disodium ethylenediaminetetraacetate | 2 | g |
| potassium sulfite | 60 | g |
| boric acid | 4 | g |
| potassium carbonate | 20 | g |
| sodium bromide | 5 | g |
| diethylene glycol | 20 | g |
| pH (adjusted with sodium hydroxide) | 10.0 | |
| water to make | 1 | L |

The obtained results are given in Table 9.

TABLE 9

| Emulsion | Cl Content in the 3rd Layer (mol %) | Silver Iodide Content in the Outermost Layer (mol %) | Presence or Absence of Silver Halide Protrusion | Timing of Dye Addition | Sensitivity | |
|---|---|---|---|---|---|---|
| A | 0 | 6 | Absence | Before Washing | 100 | Comparison |
| B | 2 | 6 | Absence | Before Washing | 100 | Comparison |
| C | 10 | 6 | Absence | Before Washing | 100 | Comparison |
| D | 30 | 6 | Absence | Before Washing | 100 | Comparison |
| E | 0 | 6 | Present | Before Washing | 100 | Comparison |
| F | 2 | 6 | Present | Before Washing | 180 | Invention |
| G | 10 | 6 | Present | Before Washing | 170 | Invention |
| H | 30 | 6 | Present | Before Washing | 100 | Comparison |

Sensitivity was expressed assuming the sensitivity of Emulsion A as 100.

With respect to the samples prepared with the use of emulsions Em-A to Em-D having no silver halide protrusion, no sensitivity change was recognized even when the Cl content of the third layer was changed.

In contrast, although no sensitivity enhancement was recognized in emulsion Em-E having a silver halide protrusion, remarkable sensitivity enhancements were recognized in emulsions Em-F and Em-G each having silver halide protrusions and containing chloride in the third layer. However, no sensitivity enhancement was recognized in emulsion Em-H whose silver chloride content was outside the range of the present invention.

It is apparent that the effect of the silver halide protrusion is remarkably exerted when the silver chloride-containing layer has the silver chloride content falling within the range of the present invention.

EXAMPLE 6

Preparation of Emulsions Em-I to Em-M

Emulsions having outermost layers varied in silver iodide contents were prepared in the same manner as in the preparation of emulsion Em-F of Example 5, except that the ratio of potassium bromide to potassium iodide in the aqueous halogen solution in the step (vii) was varied.

Coating samples were prepared in the same manner as in Example 5, and the photographic performance thereof was evaluated.

The results are listed in Table 10.

TABLE 10

| Emulsion | Cl Content in the 3rd Layer (mol %) | Silver Iodide Content in the Outermost Layer (mol %) | Presence or Absence of Silver Halide Protrusion | Timing of Dye Addition | Sensitivity | |
|---|---|---|---|---|---|---|
| I | 2 | 0 | Present | Before Washing | 160 | Invention |
| J | 2 | 3 | Present | Before Washing | 160 | Invention |
| F | 2 | 6 | Present | Before Washing | 170 | Invention |
| K | 2 | 10 | Present | Before Washing | 180 | Invention |
| L | 2 | 30 | Present | Before Washing | 170 | Invention |
| M | 2 | 40 | Present | Before Washing | 120 | Invention |

Sensitivity was expressed assuming the sensitivity of Emulsion A as 100.

The photographic sensitivity changed in accordance with the change of the silver iodide content of the outermost layer. Especially preferred results were obtained when the silver iodide content ranged from 5 to 30 mol %.

EXAMPLE 7

Preparation of Emulsions Em-N and Em-O

Emulsion Em-N was prepared in the same manner as in the preparation of emulsion Em-F of Example 5, except that the dye addition was conducted subsequent to the step (ix) in place of the step (viii).

Further, emulsion Em-O was prepared in the same manner as in the preparation of emulsion Em-F of Example 5, except that 50% of the dye was added in the step (viii) and the resting 50% was added subsequent to the step (ix).

The photographic performance thereof was evaluated in the same manner as in Example 5. The results are summarized in Table 11.

It is apparent from a comparison of emulsions Em-R, Em-S and Em-T that, with respect to silver halide protrusions, a mixed crystal of silver chloride and silver bromide exhibits a photographic sensitivity higher than that of silver chloride alone. Further, it is apparent from a comparison of emulsions Em-F, Em-P and Em-R that silver chloroiodobromide is preferred to silver chlorobromide. Still further, as apparent from a comparison of emulsions Em-F, Em-P, Em-Q and Em-R, the iodine content is preferably at least 5 mol % but iodine contents exceeding 30 mol % caused unfavorable photographic performance.

TABLE 11

| Emulsion | Cl Content in the 3rd Layer (mol %) | Silver Iodide Content in the Outermost Layer (mol %) | Presence or Absence of Silver Halide Protrusion | Timing of Dye Addition | Sensitivity | |
|---|---|---|---|---|---|---|
| F | 2 | 6 | Present | Before Washing | 180 | Invention |
| N | 2 | 6 | Present | After Washing | 130 | Invention |
| O | 2 | 6 | Present | Before Washing + After Washing | 160 | Invention |

Sensitivity was expressed assuming the sensitivity of Emulsion A as 100.

As apparent from Table 11, is was especially preferred that the dye addition be conducted after the completion of addition of the aqueous solution of silver nitrate and aqueous solution of halide salt for forming the outermost layer but before the water washing.

The dye addition after the water washing caused deterioration of the photographic sensitivity, and the divided additions before the water washing and after the water washing caused the sample to exhibit a photographic sensitivity intermediate between those before and after the water washing.

EXAMPLE 8

Preparation of Emulsions Em-P to Em-T

Emulsions Em-P to Em-T were prepared in the same manner as in the preparation of emulsion Em-F of Example 5, except that the proportions of sodium chloride, potassium bromide and potassium iodide in the step (viii)-2 were varied, thereby preparing silver halide protrusions with various halogen compositions. The photographic sensitivity thereof was evaluated in the same manner as in Example 5. The results are summarized in Table 12.

EXAMPLE 9

Preparation of Sample 900

A multilayered lightsensitive material for color photography was prepared in the same manner as in Sample 201 in Example 2, except that the amount of Emulsion G in the 10th layer was changed to 0.30 g in terms of silver, and the amount of Emulsion J in the 15th layer was changed to 0.20 g in terms of silver.

The characteristics of grains of silver iodobromide emulsions A to O used in sample 900 are as specified in the above Table 4.

The spectral sensitizing dyes added to the above emulsions A to O and the amounts thereof are as listed in the above Tables 5 and 6.

The chemical formulae used in sample 900 is the same as those used in sample 201 in Example 2.

(2) Preparation of Samples 901 to 920

Samples 901 to 920 were prepared in the same manner as sample 900, except that emulsions A and B employed in the 4th layer were replaced by emulsions Em-A to Em-T prepared in Examples 5 to 8.

TABLE 12

| Emulsion | Cl Content in the 3rd Layer (mol %) | Silver Iodide Content in the Outermost Layer (mol %) | Presence or Absence of Silver Halide Protrusion | Halide Composition of Silver Halide Protrusion Cl/Br/I | Timing of Dye Addition | Sensitivity | |
|---|---|---|---|---|---|---|---|
| F | 2 | 6 | Present | 48/37/15 | Before Washing | 180 | Invention |
| P | 2 | 6 | Present | 53/42/5 | Before Washing | 160 | Invention |
| Q | 2 | 6 | Present | 30/30/40 | Before Washing | 110 | Invention |
| R | 2 | 6 | Present | 55/45/0 | Before Washing | 140 | Invention |
| S | 2 | 6 | Present | 85/15/0 | Before Washing | 120 | Invention |
| T | 2 | 6 | Present | 100/0/0 | Before Washing | 110 | Invention |

Sensitivity was expressed assuming the sensitivity of Emulsion A as 100.

(3) Evaluation of Samples (a) Sensitivity

The sensitivity of each of the prepared samples 901 to 920 was determined by conducting a wedge exposure with the use of a 2000 lux white light source of 4800 K color temperature in 1/100 sec, conducting the same development as in Example 2, measuring the exposure imparting a cyan density of 0.5 and calculating a relative value of the inverse of the relative exposure.

(b) Interlayer Effect

The interlayer effect from green-sensitive layer to red-sensitive layer was measured by the method described in JP-A-7-92628. Measurement was performed at a cyan density of 0.5.

The processing step and processing solution of standard developing treatment are the same as those used in Example 2.

The results together with characteristics of each coating sample are listed in Table 13.

TABLE 13

| Sample No. | Emulsion | Cl Content in the 3rd Layer (mol %) | Silver Iodide Content in the Outermost Layer (mol %) | Presence or Absence of Silver Halide Protrusion | Halide Composition of Silver Halide Protrusion Cl/Br/I | Timing of Dye Addition | Sensitivity | Degree of Interlayer Effect from Green-sensitive Layer to Red-sensitive Layer | |
|---|---|---|---|---|---|---|---|---|---|
| 901 | A | 0 | 6 | Absence | 48/37/15 | Before Washing | 100 | 100 | Comparison |
| 902 | B | 2 | 6 | Absence | 48/37/15 | Before Washing | 100 | 100 | Comparison |
| 903 | C | 10 | 6 | Absence | 48/37/15 | Before Washing | 100 | 100 | Comparison |
| 904 | D | 30 | 6 | Absence | 48/37/15 | Before Washing | 100 | 100 | Comparison |
| 905 | E | 0 | 6 | Present | 48/37/15 | Before Washing | 100 | 100 | Comparison |
| 906 | F | 2 | 6 | Present | 48/37/15 | Before Washing | 180 | 200 | Invention |
| 907 | G | 10 | 6 | Present | 48/37/15 | Before Washing | 170 | 180 | Invention |
| 908 | H | 30 | 6 | Present | 48/37/15 | Before Washing | 100 | 150 | Invention |
| 909 | I | 2 | 0 | Present | 48/37/15 | Before Washing | 160 | 220 | Invention |
| 910 | J | 2 | 3 | Present | 48/37/15 | Before Washing | 160 | 210 | Invention |
| 911 | K | 2 | 10 | Present | 48/37/15 | Before Washing | 180 | 180 | Invention |
| 912 | L | 2 | 30 | Present | 48/37/15 | Before Washing | 180 | 150 | Invention |
| 913 | M | 2 | 40 | Present | 48/37/15 | Before Washing | 120 | 140 | Invention |
| 914 | N | 2 | 6 | Present | 48/37/15 | After Washing | 130 | 200 | Invention |
| 915 | O | 2 | 6 | Present | 48/37/15 | Before Washing + After Washing | 160 | 200 | Invention |
| 916 | P | 2 | 6 | Present | 53/42/5 | Before Washing | 160 | 200 | Invention |
| 917 | Q | 2 | 6 | Present | 30/30/40 | Before Washing | 110 | 200 | Invention |
| 918 | R | 2 | 6 | Present | 55/45/0 | Before Washing | 140 | 200 | Invention |
| 919 | S | 2 | 6 | Present | 85/15/0 | Before Washing | 120 | 200 | Invention |
| 920 | T | 2 | 6 | Present | 100/0/0 | Before Washing | 110 | 200 | Invention |

The degree of interlayer effect was expressed assuming the value of Sample 901 as 100. The larger the value is, the more interimage effect is received The sample including the emulsion of the present invention exhibited the same high sensitivity as that of the monolayer coating. With respect to the magnitude of the interlayer effect, although no significant change is recognized in comparative samples 901 to 905, it is apparent that substantial changes of the magnitude of the interlayer effect are recognized in samples 906 to 920 according to the present invention although some thereof have similar sensitivities.

As apparent from the above, the emulsion of the present invention is characterized by being highly sensitive and enabling more extensive control of the magnitude of the interlayer effect than in the use of the conventional emulsions.

EXAMPLE 10

Emulsion evaluation was performed in the same manner as in Example 1 of JP-A-8-76311, except that the emulsion of the present invention was used in place of emulsions A, B of the fourth layer. The emulsion of the present invention exhibited high sensitivity and exerted a marked effect of the present invention.

The silver halide emulsion of the second embodiment of the present invention and silver halide photographic light-sensitive material using the same are characterized by being highly sensitive and having interlayer effect regulating means.

I claim:

1. A silver halide photographic emulsion that is occupied by tabular grains having an equivalent circular diameter of 0.1 to 0.6 $\mu$m in an amount of at least 70% in number, wherein each of the tabular grains:

has a multilayer structure comprising at least two layers, and at least one of the layers contains chloride in an amount of 0.4 to 20 mol % based on the amount of silver forming the layer, and has a silver halide protrusion.

2. The emulsion according to claim 1, wherein a spectral sensitizing dye was added before a water washing step to produce the emulsion.

3. The emulsion according to claim 1, wherein each tabular grain has an outermost layer whose silver iodide content is 5 to 30 mol %.

4. The emulsion according to claim 3, wherein a spectral sensitizing dye was added before a water washing step to produce the emulsion.

* * * * *